US005806422A

United States Patent [19]

Hamu

[11] Patent Number: 5,806,422

[45] Date of Patent: Sep. 15, 1998

[54] METHOD AND APPARATUS FOR REGISTERING A SCREEN FRAME TO A WORK SUPPORT

[75] Inventor: Alan J. Hamu, Sunset Beach, Calif.

[73] Assignee: Kaino J. Hamu, Huntington Beach, Calif.

[21] Appl. No.: 539,054

[22] Filed: Oct. 4, 1995

Related U.S. Application Data

[63] Continuation-in-part of Ser. No. 316,229, Sep. 30, 1994.

[51] Int. Cl.[6] ..... B41F 15/10; B41F 15/16; B41F 15/36

[52] U.S. Cl. ..... 101/115; 101/126; 101/127.1; 101/DIG. 36

[58] Field of Search ..... 101/115, 126, 101/127.1, 128, 128.1, 129, 481, 485, 486, DIG. 36; 33/614, 615, 617, 620, 621

[56] References Cited

U.S. PATENT DOCUMENTS

| | | | |
|---|---|---|---|
| 2,438,639 | 3/1948 | Lawrence | 101/126 |
| 3,943,851 | 3/1976 | Inada et al. | 101/127.1 |
| 4,463,673 | 8/1984 | Moore | 101/129 |
| 4,669,378 | 6/1987 | Lee | 101/115 |
| 4,723,487 | 2/1988 | Richardson | 101/126 |
| 4,738,909 | 4/1988 | Jennings | 101/126 |
| 4,846,058 | 7/1989 | Farris | 101/126 |
| 4,911,070 | 3/1990 | Miske et al. | 101/126 |
| 4,938,130 | 7/1990 | Thorpe | 101/126 |
| 4,949,635 | 8/1990 | Padula | 101/115 |
| 4,993,166 | 2/1991 | Bradley | 101/127.1 |
| 5,094,161 | 3/1992 | Taylor | 101/115 |
| 5,127,321 | 7/1992 | Proffer | 101/115 |
| 5,188,026 | 2/1993 | Fuqua et al. | 101/129 |
| 5,226,362 | 7/1993 | Iaccino et al. | 101/129 |
| 5,239,923 | 8/1993 | Belcher et al. | 101/115 |
| 5,377,422 | 1/1995 | Newman | 101/127.1 |
| 5,483,882 | 1/1996 | Jaffa | 101/128 |
| 5,503,068 | 4/1996 | Newman | 101/126 |

*Primary Examiner*—Stephen R. Funk
*Attorney, Agent, or Firm*—Boniard I. Brown

[57] ABSTRACT

The several screen frames of a multistation screen printing machine, such as a carousel screen printer, having multiple work supports movable to the printer stations in succession to effect successive printing of screen images on work pieces fixed to the supports are precisely registered with the work supports by providing each frame with two and preferably three registration points precisely located relative to the screen image on the frame, providing a selected work support with the same number of registration points precisely located relative to the position of a work piece on the selected support, effecting movement of the selected work support to the print stations in succession, adjusting the corresponding screen frame to directly align its registration points with the registration points on the selected work support, and securing the frame in fixed position relative to its respective print station while the frame and work support are firmly held in fixed position by registration pins extending between the corresponding registration points of the frame and work support.

22 Claims, 12 Drawing Sheets

METHOD AND APPARATUS FOR REGISTERING A SCREEN FRAME TO A WORK SUPPORT

RELATED APPLICATIONS

This application is a continuation-in-part of copending application Ser. No. 08/316,229, filed Sep. 30, 1994.

BACKGROUND OF THE INVENTION

1. Field of the Invention

This invention relates generally to the silk screen printing art and more particularly to an improved registration method and apparatus for registering, that is aligning, the silk screen image(s) to be printed relative to the workpieces to be imprinted with such screen image(s).

2. Discussion of the Prior Art

The printing procedure commonly referred to as silk screen printing is very old and well known and utilized to imprint both monochrome and multicolor images on a vast assortment of articles. A wide variety of screen printing devices have been devised ranging from the very simple comprising a frame for holding a printing screen, a support for the work piece to be imprinted, and a manual squeegee for wiping a printing ink across the screen, to automatic multistation screen printing machines for high speed printing of multicolor images.

Following is a list of patents disclosing screen printers and related registration systems:

U.S. Pat. No. 3,943,851 dated Mar. 16, 1976, to Inada discloses a system for aligning a sheet containing an image to be printed relative to a printing screen on which the image is to be reproduced.

U.S. Pat. No. 4,463,673 dated Aug. 7, 1984, to Moore discloses a system for aligning a first sheet relative to a second sheet containing an image to be printed on the first sheet.

U.S. Pat. No. 4,669,378 dated Jun. 2, 1987, to Lee discloses a multiple station carousel screen printer including alignment gates at the printing stations for angularly aligning printing screens at the stations with platens supporting workpieces to be printed.

U.S. Pat. No. 4,846,058 dated Jul. 11, 1989, to Farris discloses a system for screen printing a sequence of accurately registered images involving imprinting test images on a transparent register plate to check image registration.

U.S. Pat. No. 4,949,635 dated Aug. 21, 1990, to Padula discloses a multicolor carousel screen printer having screen frame supports which are adjustable to register the printing screens relative to the workpieces to be imprinted.

U.S. Pat. No. 4,993,166 dated Feb. 19, 1991, to Bradley discloses means for adjusting a printing screen frame relative to a screen printer pin bar.

U.S. Pat. No. 5,127,321 dated Jul. 7, 1992, to Proffer discloses a system for pre-registering a set of related film positives relative to one another and a carousel screen printer in which each screen holder and each print head have coacting means for aligning the holder and print head about the rotation axis of the printer turret.

U.S. Pat. No. 5,188,026 dated Feb. 23, 1993, to Fuqua and U.S. Pat. No. 5,226,362 dated Jul. 13, 1993, to Iaccino et al disclose multistation carousel screen printers having a calibration pallet rotatable to the print stations in succession, and means at each station for indirectly pin registering a printing screen at each station to the calibration pallet by first pin-registering a pair of alignment brackets at the respective station to the calibration pallet and thereafter pin-registering a screen frame mounting the printing screen to the alignment brackets.

U.S. Pat. No. 5,239,923 dated Aug. 31, 1993, to Belcher et al discloses a multistation screen printer having ball and socket means at each station for effecting screen/pallet registration.

The present invention is concerned primarily with, and will be described in the context of, a multistation, multicolor printing machine, specifically a so-called carousel screen printer. It will become evident as the description proceeds, however, that the present registration invention may be used on other types of screen printers.

Simply stated, a carousel screen printer comprises a number of print stations spaced circumferentially about a vertical axis, a rotary turret mounting an equal number of work supports including work pallets spaced circumferentially about the axis, and means for rotating the turret to align the pallets with the print stations in succession. Each pallet is elevated to and lowered from a raised printing position at each station. Each print station includes a holder supporting a screen frame mounting a printing screen having blocked and unblocked screen apertures or pores defining an image to be printed. Each print station also includes a so-called flood bar movable back and forth across the upper side of the screen for spreading a printing ink across the screen and forcing the ink through the open screen pores. The images on the several printing screens comprise color separation images of a completed multicolor image to be printed.

Operation of a carousel screen printer involves (a) mounting a workpiece to be imprinted on each work pallet, (b) rotating the printer turret stepwise through its successive printing positions to rotate the work pallets to the print stations in succession, (c) elevating the pallets at the successive print stations to their printing positions in which the work pieces on the pallets contact the undersides of the respective printing screens, and (d) driving the flood bars back and forth across the upper sides of their respective screens while the pallets are in their elevated printing positions to imprint the respective screen images on the work pieces. The several screen images are thereby imprinted in succession on each work piece. Each of these several screen images is printed in a different single color. The shapes of the several screen images and the different colors in which these images are successively imprinted on each work piece are selected to produce on each workpiece a desired composite multicolor image.

Successful screen printing of such a composite multicolor image requires very precise screen image-to-work piece registration in order to achieve the precise registration or alignment of the several color separation images successively imprinted on each work piece. A variety of registration systems for this purpose have been devised. These prior registration systems range from those in which registration of the successive printed images is accomplished by visual observation, as in the Farris U.S. Pat. No. 4,846,058, to those registration systems which involve positive mechanical registration, as in the Fuqua U.S. Pat. No. 5,188,026 and Iaccino et al U.S. Pat. No. 5,226,362. The prior visual/manual registration procedures are very time consuming and require the services of a skilled technician and hence are quite costly. The Fuqua and Iaccino et al mechanical registration systems are two stage registration systems which involve a two step registration procedure at each print station, as discussed below, and hence are also relatively time consuming and costly.

The precise image registration essential to multicolor screen printing involves three basic requirements. These requirements are: (1) precise registration (i.e. precise predetermined location or alignment) of each screen image relative to its respective screen frame, (2) precise registration of each screen frame relative to each work pallet, and (3) precise registration of each work piece relative to its work pallet, that is proper placement of each work piece on its work pallet in precise alignment with the pallet.

In the Fuqua and Iaccino et al screen printers, these three requirements are accomplished by utilization of a vacuum table, a calibration pallet, screen frames having registration holes, and adjustable alignment brackets having registration holes. The vacuum table mounts registration pins which are engagable in the registration holes of the screen frames. The calibration pallet replaces one work pallet of the printer during the registration mode of the printer and is rotated to the printer print stations in succession. Image registration involves the following registration procedure. A film positive transparency bearing a color separation image to be printed at each print station is prepared and secured to the vacuum table with the film positive image located in a predetermined position relative to the registration pins on the table. A screen frame mounting a photo-resist-coated printing screen is placed on the vacuum table over the film positive with the table registration pins engaging in the frame registration holes to locate the frame, and more importantly the frame registration holes, in a predetermined registered position relative to the film positive image. The film positive is then secured to the frame, after which the frame and film positive are removed from the table, exposed, and processed to produce on the screen a negative image corresponding to the film positive image and registered with, that is located in a predetermined registered position relative to, the frame registration holes. This part of the registration procedure is repeated for each screen frame of the printer and provides a plurality of screen frames bearing registered color separation screen images to be sequentially imprinted on each work piece.

The remainder of the Fuqua/Iaccino registration procedure involves indirect registration of the screen frame at each print station with the calibration pallet. This is accomplished by aligning and then inserting registration pins through the registration holes in the print station alignment brackets and the registration holes in the calibration pallet to pin-register the alignment brackets with the calibration pallet while this pallet is situated at the respective print station. The alignment brackets of the print station are then clamped in their registered positions and a screen frame is placed at the print station. Registration pins are then inserted through the registration holes in the screen frame and in the fixed alignment brackets to pin-register the frame with the alignment brackets.

This registration procedure is repeated at each print station. The calibration pallet is then replaced by a normal work pallet, the work pieces to be printed are placed in the proper positions on the several work pallets, and the screen printer is operated to print the successive color separation images on the workpieces.

BRIEF DESCRIPTION OF THE INVENTION

This invention provides an improved image registration apparatus and method for screen printers having an image registration mode and a printing mode, and wherein the screen image on each screen frame is registered directly with each printer work support. In its simplest form, a screen printer embodying the invention may comprise a single screen frame, a single print station including a screen frame holder for supporting the screen frame, a work support mounting a work pallet or the like for receiving a work piece to be printed, and means for effecting relative movement of the print station and work support to and from a printing position in which the work pallet is disposed in printing relation with the screen frame. The screen frame mounts a printing screen bearing a screen image which has been previously registered with, that is located in a predetermined position relative to, the screen frame by utilization of a vacuum table in the same manner as discussed above in connection with the Fuqua and Iaccino et al patents. The screen frame holder of the printer supports the screen frame for edgewise adjustment of the frame relative to the holder and includes means for releasably securing the frame to the holder in a fixed position relative to the print station.

This invention provides positive frame registration means including alignment means directly engagable between the screen frame and the work support to directly register the screen frame and hence its screen image with the work support, whereby the screen image will be imprinted in predetermined position on a work piece placed in the proper printing position on the work support. In the preferred inventive embodiments described herein, the registration alignment means are registration pins directly engagable between the screen frame and a registration device mounted on the printer work support. In one described embodiment, this registration device is a registration attachment tool which is removably mounted on the work support during the printer registration mode. In another described embodiment, the registration device is a registration replacement tool which replaces the printer work support during the printer registration mode. In yet another described embodiment, the registration device is the printer work support itself.

In the registration mode of the printer, the work support is aligned with the print station. The screen frame is placed in the frame holder of the print station and directly registered with, that is directly aligned in a predetermined position relative to, the registration device on the work support by manual adjustment of the frame relative to its holder to a position which permits direct engagement of the registration means between the frame and registration device. The screen frame is then firmly fixed in its registered position relative to the screen holder.

During operation of the printer in its printing mode, a work piece to be printed is placed on the work support in a proper printing position relative to the support. The work support and screen frame are moved toward one another to place the work piece in printing contact with the underside of the printing screen, after which a printing ink is spread across the upper side of the screen and forced through the open pores of the screen to imprint the screen image on the work piece in the same manner as in a conventional screen printer. Since the screen image is precisely registered with the screen frame, the frame is precisely registered with the work support by direct engagement of the registration means between the frame and the registration device on the work support, and the work piece occupies a precise printing position on the work support, the screen image and work piece are precisely registered relative to one another to achieve precise printing of the screen image in the proper position on the work piece.

The invention is primarily intended for use on a multi-station carousel printer for printing a series of color separation images in succession on work pieces with the several images on each workpiece precisely registered relative to one another to form a composite multicolor image. In the registration mode of this carousel printer, the screen frames at all of the print stations of the printer are registered with one particular printer work support (registration work support) by rotating the latter support to the print stations in succession, elevating the registration support to its raised position at each station, and then utilizing the registration means of the invention to precisely register the respective screen frame directly with the registration support. The work supports of such a carousel printer are work pallets mounted on support arms.

The registration procedure of the invention involves mounting a registration device according to the invention, i.e. a pallet attachment tool, pallet replacement tool, or registration pallet, on one printer support arm (registration support arm) and effecting direct engagement of registration pins between this registration device and the screen frame at each print station. This procedure directly registers the screen image on each screen frame with the registration support arm and thereby effects registration of the screen image with a work pallet mounted on the registration support arm and with a work piece mounted on the latter pallet. Each registered screen frame is fixed in its registered position at its print station, after which the registration work support is rotated to the next print station and this registration procedure is repeated. Since the several work pallets of a carousel printer are aligned circumferentially about the printer rotation axis, registration of each frame with the work pallet on the registration support arm is effective to register the frame with all of the work pallets.

During operation of the carousel printer in its normal printing mode, a work piece to be printed is placed on each work pallet of the printer. The printer turret is rotated stepwise to locate the work pallets at the several print stations of the printer in succession while the pallets are in lower retracted positions. The work pallets are elevated to raised printing positions at each print station to press their work pieces against the undersides of the printing screens, and ink flood bars and squeegees are driven across the upper sides of the screens to imprint the screen images on the work pieces.

In certain described embodiments of the invention, the screen frame at each print station is pin registered at two registration points along the front edge of the frame. In this case, the earlier discussed image registration procedure utilizing a vacuum table for registering a screen image relative to each screen frame employs two registration points (registration pins) on the table and two registration points (registration holes receiving the registration pins) on each screen frame for registering the frame relative to the film positive on the table. In other described, presently preferred inventive embodiments, the screen frame at each print station is pin registered at three registration points located adjacent three corners of the frame in a manner which achieves more precise registration of each frame. In this case, the image registration procedure utilizing a vacuum table for registering a screen image relative to each screen frame employs three registration points (registration pins) on the table and three registration points (registration holes receiving the registration pins) on each screen frame for registering the frame relative to the film positive on the table. The frame registration device in one of these three-registration-point embodiments is adjustable to adjust the spacing between certain of its three registration points. The three point pin registration means of the invention includes a calibration tool for effecting precise relative positioning of these adjustable registration points.

The preferred three point pin registration means of the invention includes registration pins engagable in registration holes in the screen frames and the registration device. According to a unique feature of the invention, certain of these registration holes are slots arranged in a unique manner which reduces the dimensional tolerances required in the manufacture and assembly of the screen frames and facilitates the registration procedure of the invention.

DESCRIPTION OF THE PREFERRED EMBODIMENTS

Figure 1:
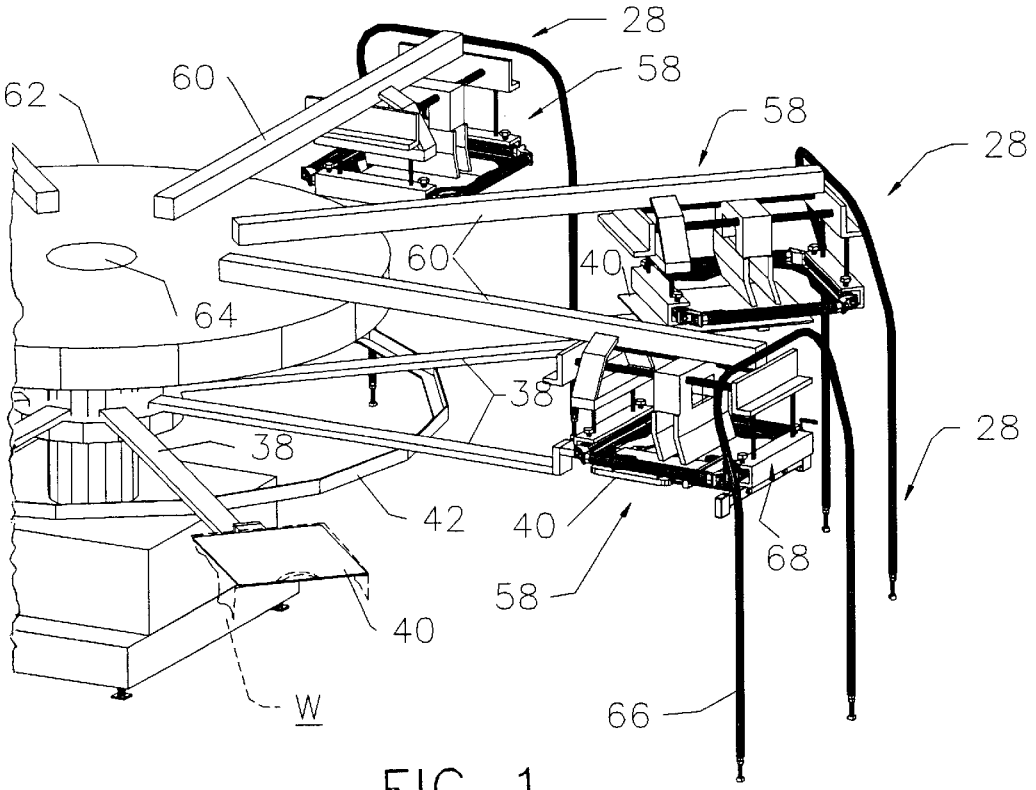
FIG. 1 is a fragmentary perspective view of a carousel multicolor screen printer embodying improved direct screen frame-to-work pallet registration system according to the invention.

Turning now to these drawings and first to FIGS. 1–5, there is illustrated a screen printer 20 including improved registration means according to this invention. Except for the improved registration means of the invention, the printer 20 is conventional and hence need be described only in sufficient detail to enable a full and complete understanding of the invention. With this in mind, the illustrated screen printer is a carousel multicolor printer including a base 22 rotatably supporting a rotary turret 24 which turns on a vertical rotation axis 26, and a plurality of print stations 28 spaced circumferentially about the turret. Within the base are means (not shown) for driving the turret 24 in stepwise rotation about its rotation axis 26.

Turret 24 includes a central tubular support column 30 coaxial with the rotation axis 26 and rotatably supported at its lower end on the base 22 for rotation on the rotation axis. The turret driving means within the base are drivably coupled to the lower end of the column for driving the column in the later described stepwise rotation. Mounted on the column 30 for rotation with and axial movement along the column is a relatively rigid work support structure or work support table 32. Within the base 22 and turret 24 are means (not shown) for moving this work support table up and down along the column 30 in timed relation to stepwise rotation of the column, as explained later. The work support table is movable vertically along the column between its lower solid line retracted position and its upper broken line printing position in FIG. 2.

The work support table 32 includes a central collar 34 slidable along and rotatably with the column 30, and a plurality of radial work supports or support arms 38 rigidly secured at their inner ends to the collar 34 and mounting work support pallets 40 at their outer ends. The several radial work support arms 38 are rigidly joined by a connecting ring 42 concentric with the collar 34. As explained later, during operation of the printer 20, the work support table 32 is moved up and down along the column 30 in timed relation to stepwise rotation of the column to move the work support pallets 40 between their solid line lower retracted positions and broken line upper printing positions in FIG. 2.

Figure 2:
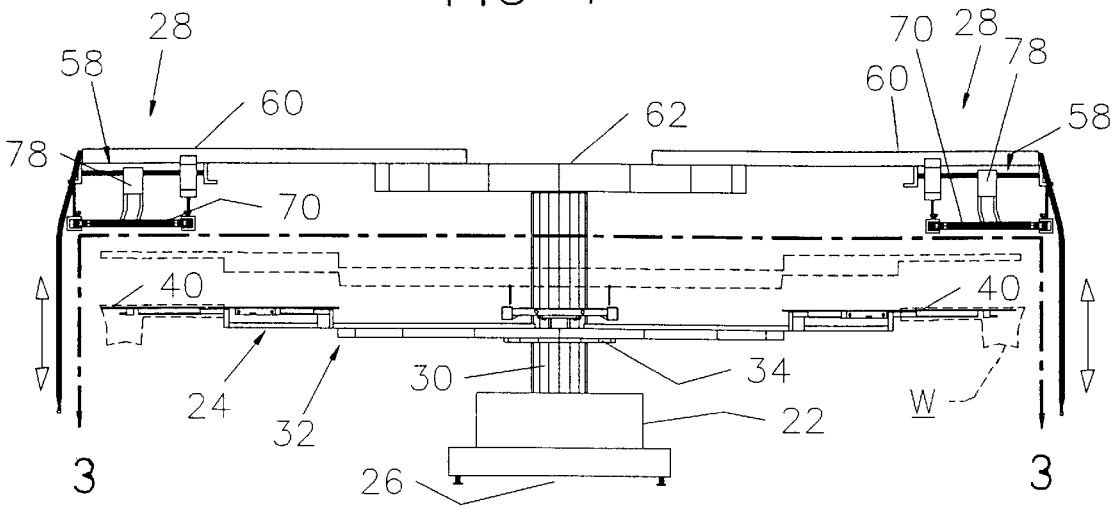
FIG. 2 is a side elevation of the printer on reduced scale.
Figure 3:
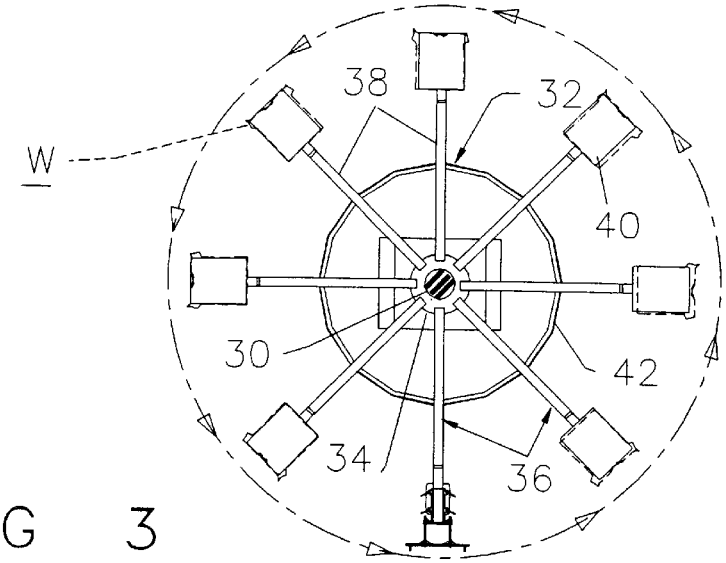
FIG. 3 is a view of the printer taken on line 3—3 in FIG. 2.
Figure 4:
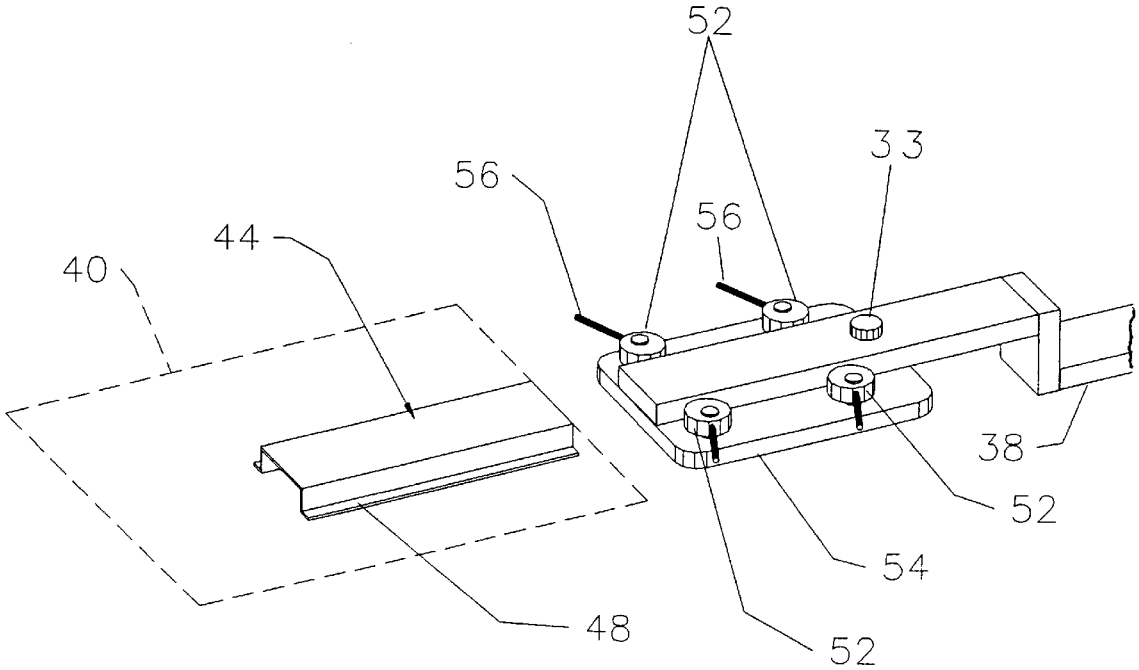
FIGS. 4 and 5 are fragmentary perspective views illustrating the manner in which work support pallets of the printer are secured to pallet support arms.
Figure 5:
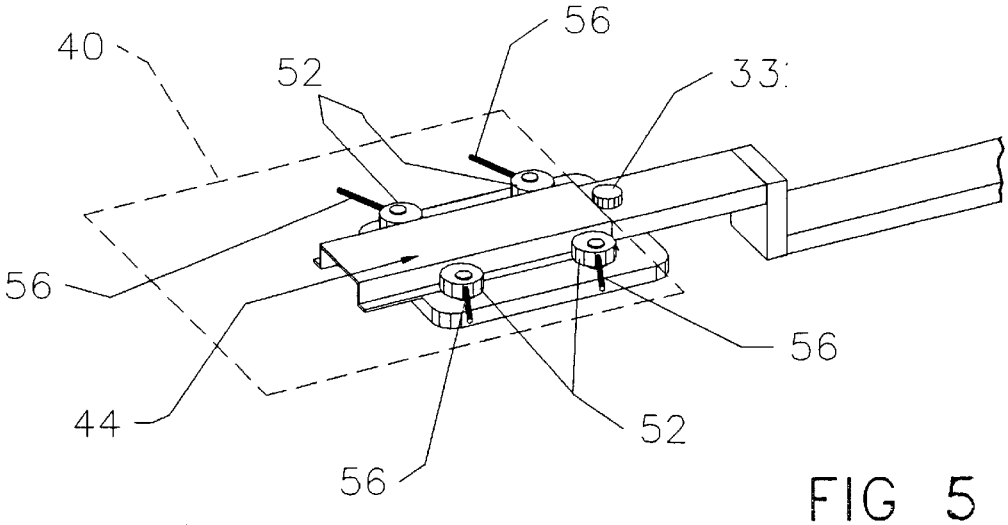

As shown in FIGS. 2 and 3, the several work support pallets 40 are located in a common plane transverse to the turret rotation axis 26 and are equally radially spaced from the axis. The pallets are removably secured to their respective support arms 38. To this end, each pallet 40 has a channel 44 (FIGS. 4 and 5) rigidly secured to its underside and aligned with the radial centerline of the pallet. The side walls 46 of this channel have out turned flanges 48 along their lower edges. The channel of each work pallet is sized to slide over the radially outer free end of its support arm 38 in the manner shown in FIG. 5. The support arms 38 have limit stops 33 engagable by their respective pallet channel 44 to locate the several pallets at equal radial distances from the rotation axis 26.

Each work pallet 40 is releasably secured to its support arm 38 by rotary eccentric clamps 52. These clamps are rotatably mounted on the upper side of a support plate 54 rigidly secured to the underside of the respective support arm at the radially outer end of the arm. When the clamps 52 are released, they permit the respective pallet 40 to slide onto and from the respective pallet support arm 38. The clamps have arms 56 by which they may be rotated to clamp and release the pallets.

Each print station 28 includes a print head 58 mounted on the outer end of a radial support arm 60 having a radially inner end rigidly joined to a center support plate 62 above the upper end of the rotary turret column 30. Plate 62 is rigidly joined to the upper end of a support shaft 64 which extends downwardly through the column 30 to and is rigidly secured at its lower end to the base 22. The outer ends of the print head support arms 60 are supported on stands 66 which rest on the floor.

Each print head 58 includes a holder 68 for supporting a rectangular screen frame 70 above and parallel to the common plane of the work pallets 40. Each printing frame 70 mounts a rectangular printing screen 72 bearing an image (not shown) to be printed. The particular screen frame shown is a roller frame like that described in U.S. Pat. No. 5,018,442. This patented screen frame includes rollers 74 forming the sides and ends of the frame and corner brackets 76 joining and rotatably supporting the adjacent roller ends. The edges of the printing screen 72 are attached to the rollers 74 which are then rotated to stretch the screen edgewise to the proper tension and then secured against rotation to maintain the screen tension. Each print head 58 also has a so-called flood bar 78 including squeegees 80. During printer operation, the flood bar 78 is driven back and forth across the upper side of the printing screen to spread printing ink across the screen and force the ink through open screen pores.

As described to this point, the printer 20 is conventional and operates in the well known way to print composite multicolor images on work pieces W by successively imprinting precisely registered color separation images on each work piece. Briefly, the printer operation is as follows. A work piece is fixed to the upper side of each work pallet 40. Screen frames 70 mounting printing screens 72 bearing the images, respectively, to be successively imprinted on each work piece are mounted in the screen holders 68. The turret 24 is driven in stepwise rotation to rotate the work pallets 40 to the print stations 28 in succession while the turret work table 32 is in its lower solid line retracted position of FIG. 2. Each turret position in which the work pallets are thus aligned with the print stations is referred to herein as a printing position of the turret. While at each printing position, the turret work table 32 is elevated to its upper broken line printing position in FIG. 2 to press the work pieces W against the undersides of the printing screens 72. The flood bars 78 are then driven back and forth across the upper sides of the screens to imprint the screen images on the work pieces. The turret work table is then lowered to its retracted position and rotated to the next print stations where the above printing operation is repeated.

This invention provides improved registration means 82 for mechanically registering each screen frame 70 directly with the work pallets 40 to precisely register the images on the frame screens 72 with the work pieces W on the pallets. It is important to note here that the images on printing screens 72 used in the printer 20 will have been registered with their respective screen frames on a vacuum table in the manner explained earlier or in any other convenient way. Similarly, the work pieces to be printed will have been fixed on the work pallets 40 in the proper printing positions relative to the pallets so that direct registration of the screen frames with the pallets is effective to register the screen images with the work pieces.

The improved registration means 82 of the invention comprises screen frame supporting means 84 embodied in the frame holders 68 removably supporting the screen frames 70 for edgewise adjustment relative to their respective print heads 58, and frame securing means 86 for releasably securing the frames in fixed position relative to the print heads. The registration means 82 further includes a registration device 88 mounted on a selected turret work support or support arm 38 for rotation with the turret 24 to the print stations 28 in succession, and alignment means 90 directly engagable between the screen frame 70 at each print station 28 and the registration device 88 when the device is situated at the respective print station for registering the frame with, i.e. aligning the frame in a predetermined registered position relative to, the registration device.

In the registration mode of the printer 20, the turret 24 is driven in stepwise rotation with the work table 32 in its lower retracted position to locate the registration device 88 at the print stations 28 in succession. The screen frame 70 at each print station is adjusted edgewise relative to its supporting means 84 to effect direct engagement of the alignment means 90 with both the frame and the registration device and thereby direct registration of the frame with the registration device. As mentioned earlier, all of the work pallets 40 are located in the same (though circumferentially spaced) relative positions with respect to the turret rotation axis 26. The registration device 88, in turn, is mounted on the selected work support arm 38 in a position such that registration of each screen frame with the registration device is effective to register the respective frame with all the work pallets 40. Each registered frame is fixed in its registered position by tightening its frame securing means 86. The turret 24 is then rotated to the next print station where the above alignment procedure is repeated.

Referring now in more detail to the illustrated printer, the screen frame supporting means 84 of each print head frame holder 68 comprise a pair of channels 92 suspended by hangers 94 from overhead members 96 rigidly secured to the respective print head support arm 60. The two frame support channels 92 extend transverse to the respective support arm 60 in a common plane above and parallel to the plane of the turret work table 32. The channels open toward one another and are spaced to receive and vertically support the ends of a screen frame 70 in the common plane of the channels. The channels are spaced and sized to support the screen frames for edgewise adjustment relative to the respective print head 58 and in the common plane of the screen support channels to effect registration of the frame relative to the work pallets 40 in the manner described below. The frame securing means 86 of the frame holders 68 comprise clamp screws threaded in the upper flanges of the frame support channels 92.

Figure 7:
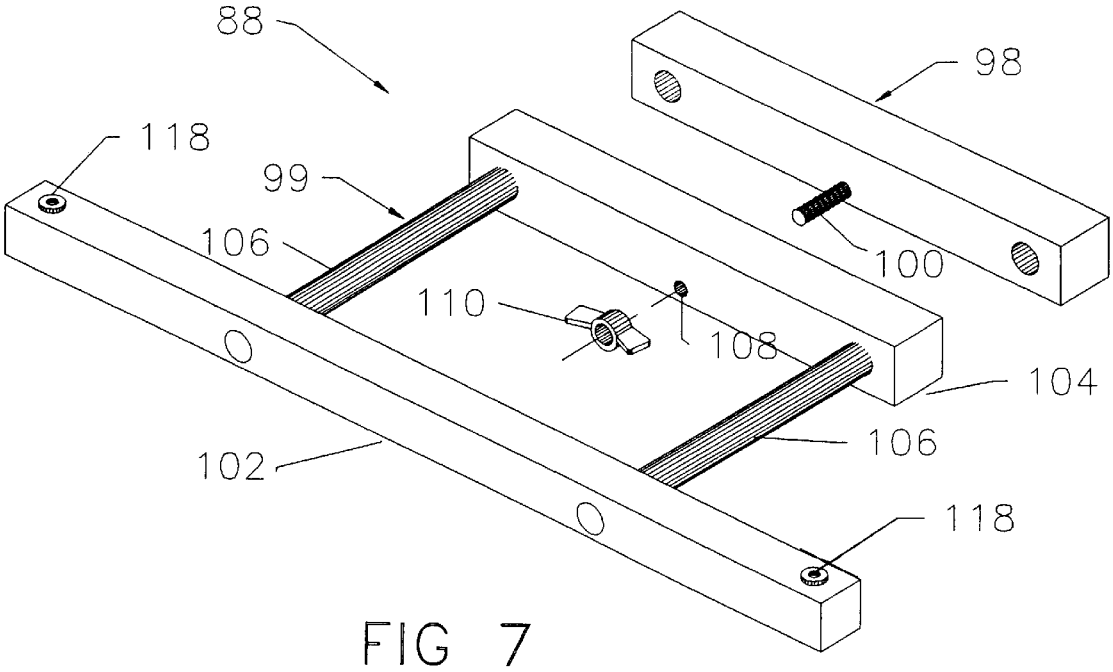
FIG. 7 is an enlarged perspective view of the pallet attachment tool shown in FIG. 6.
Figure 8:
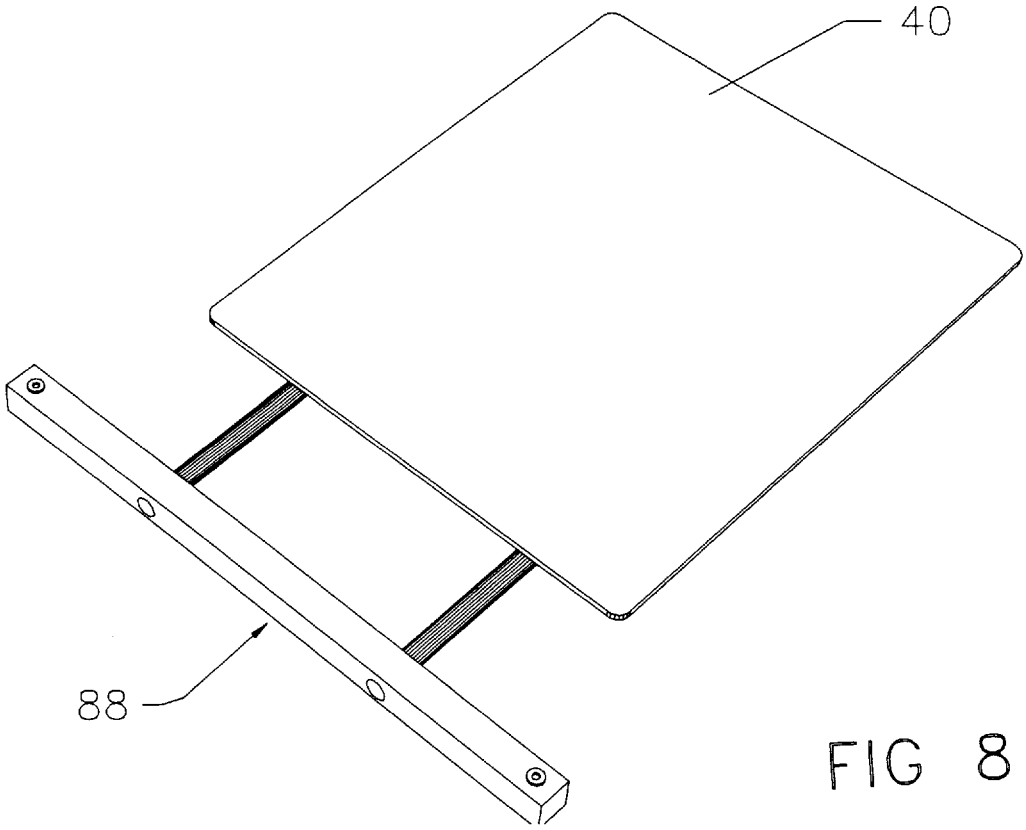
FIGS. 8 and 9 are perspective views of the upper and lower sides, respectively, of the printer work pallet and pallet attachment tool in FIG. 7.
Figure 9:
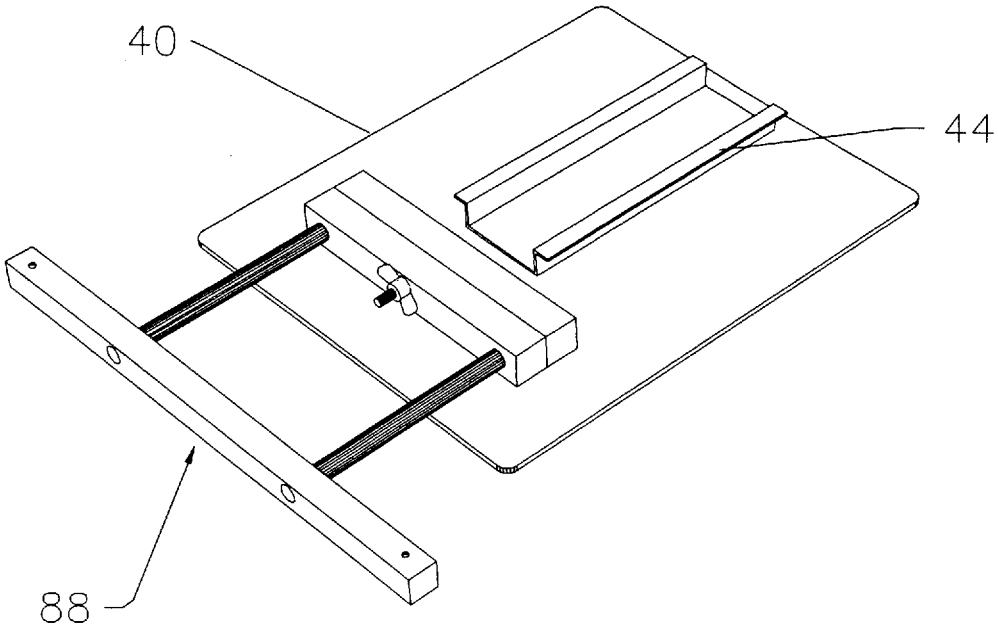

In the particular registration means 82 illustrated in FIGS. 1–12, the registration device 88 is a pallet attachment tool to be secured to a selected one of the printer work pallets 40. Referring to FIGS. 7–9, the pallet attachment tool 88 comprises normally rear and front parts 98, 99. The rear part 98 is a receiver or mounting block which is adapted to be secured to the underside of one printer work pallet 40. Extending from the normally front face of the block is a screw 100. The removable front part 99 of the pallet attachment tool 88 comprises normally front and rear bars 102, 104 rigidly joined by connecting rods 106. The rear bar 104 contains a hole 108 for receiving the mounting block screw 100. The rear mounting block 98 and front attachment part are joined by placing the rear bar 104 of the front part against the front face of the mounting block with the mounting block screw 100 extending through the hole 108 in the rear bar and then threading a thumb screw 110 or the like on the screw to hold the mounting block and front part firmly together.

The mounting block 98 and the rear bar 104 of the front attachment part 99 have approximately equal lengths somewhat less than the width of the printer work pallets 40. The length of the front attachment bar 102 is somewhat greater than the lengths of the rear bar and mounting block and the width of the work pallet.

The pallet attachment tool 88 is mounted on the underside of the selected printer work pallet 40 in the position shown in FIGS. 8 and 9. This mounting is accomplished by either removably or permanently securing the pallet attachment tool mounting block 98 to the underside of the work pallet in any convenient way, as by tape, fasteners, or welds. As shown in FIG. 9, the mounting block is positioned a distance behind the front edge of the pallet with the length of the block transverse to the fore and aft direction of the pallet. The front bar 102 of the attachment tool is positioned relative to the work pallet as discussed below.

The alignment means 90 of the improved registration means 82 comprises registration pins 114 insertable through registration holes 116 and 118 in each screen frame 70 and the pallet attachment tool 88, respectively. These registration holes may be provided by hardened bushings and are sized to receive the registration pins with a sliding fit. As shown best in FIG. 6, the registration holes 116 in each screen frame 70 extend through the two corner brackets 76 at one end of the frame with the axes of the holes transverse to the plane of the frame. This end of each frame is hereafter referred to as its front end. Each frame is positioned with its front end (i.e. the frame end containing the frame registration holes 116) located at the front end of the respective frame support, that is the right hand radially outer end of the frame support in FIG. 6. The registration holes 118 in the pallet attachment tool 88 extend through the ends of the front attachment bar 102 with the axes of the holes transverse to the plane of the pallet attachment tool. The spacing between the pallet attachment registration holes 118 equals the spacing between the frame registration holes 116.

It will be recalled from the earlier description that operation of the printer 20 in its normal printing mode involves rotation of the work pallets 40 to the print stations 28 in succession by stepwise rotation of the printer turret 24 to its printing positions in succession while the work pallets 40 are in their lower solid line retracted positions of FIG. 2. The pallets are elevated at each print station to their upper broken line printing positions of FIG. 2 against the undersides of the adjacent printing screens 72 and then lowered to their lower retracted position for rotation to the next stations. Prior to operation of the printer in this normal printing mode, the printer is operated in a registration mode during which the improved registration means 82 of the invention are utilized in the manner described below to register the printing frame 70 at each print station 28 with all the work pallets 40.

Figure 10:
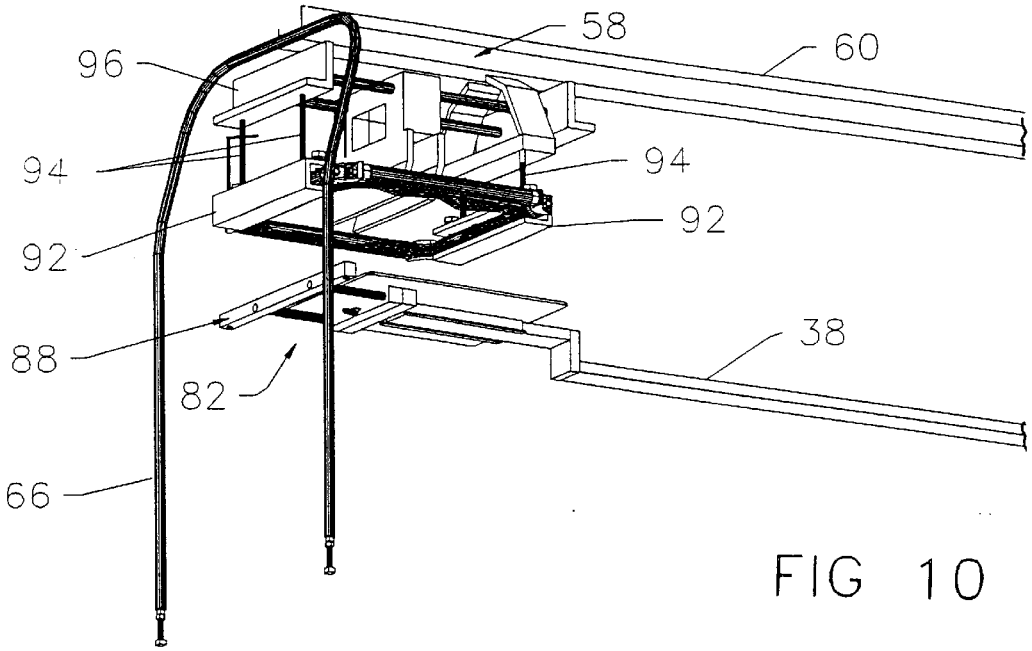
FIG. 10 is a perspective view of one print station of the screen printer illustrating the pallet attachment tool of FIGS. 7–9 in an initial position at a print station of the printer.
Figure 11:
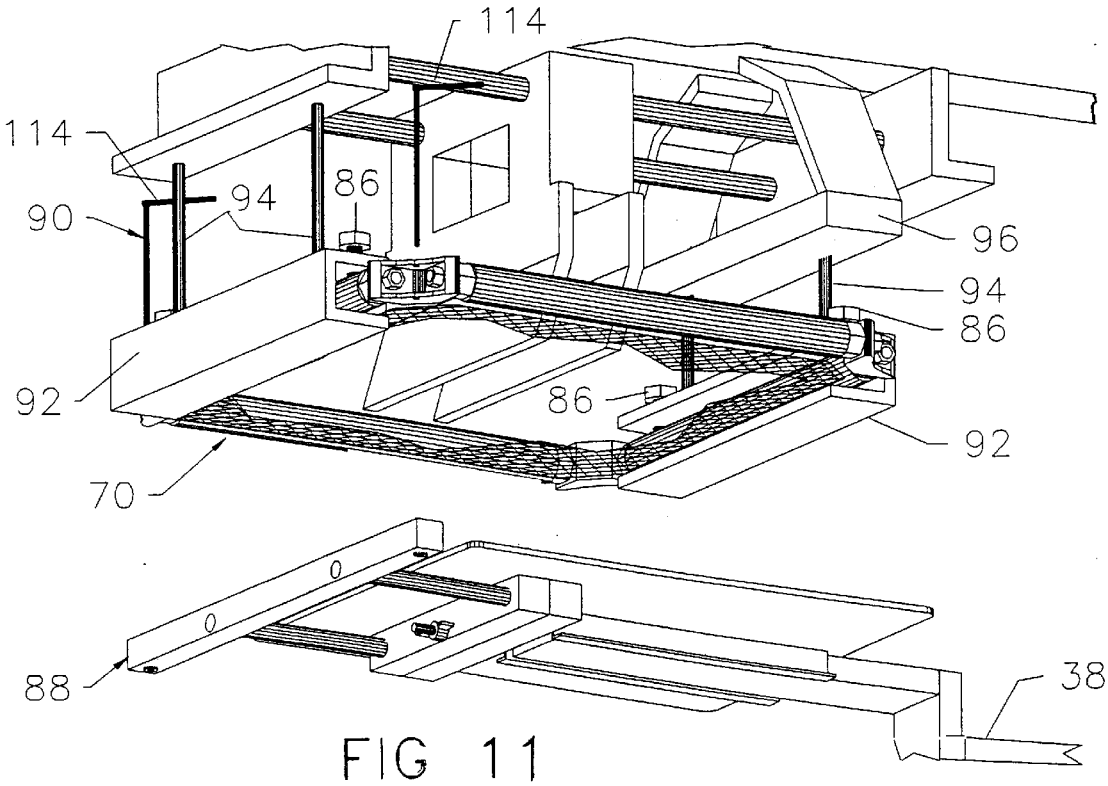
FIG. 11 is a fragmentary enlargement of FIG. 10.

The printer is conditioned for operation in its registration mode by mounting the pallet attachment tool 88 on the underside of a selected work pallet 40 in the manner shown in FIGS. 8 and 9. The printer turret 24 is then rotated stepwise to its printing positions in succession, and the turret work table 32 is elevated while in each printing position, all in essentially the same way as in normal printing operation of the printer. In contrast to the purpose of this turret movement during normal printer operation, however, the purpose of the turret movement in the registration mode is to locate the selected work pallet 40 and its pallet attachment tool 88 in registration relation to each screen frame 70. Thus, in the registration mode, the selected work pallet 40 and the pallet attachment tool are rotated to the print stations in succession while the pallet and attachment are in their lower retracted positions, as shown in FIGS. 10 and 11. The selected pallet and pallet attachment tool are elevated at each print station to the registration position of FIGS. 6 and 12. In this registration position, the pallet is disposed in close proximity to the underside of the respective printing screen 72. The pallet attachment tool 88 is disposed in registration relation to the respective screen frame 70, wherein the front bar 102 of the attachment is located below the front end of the respective screen frame support 84. The flood bars 78 are not moved across the printing screens 72 in the registration mode.

Figure 6:
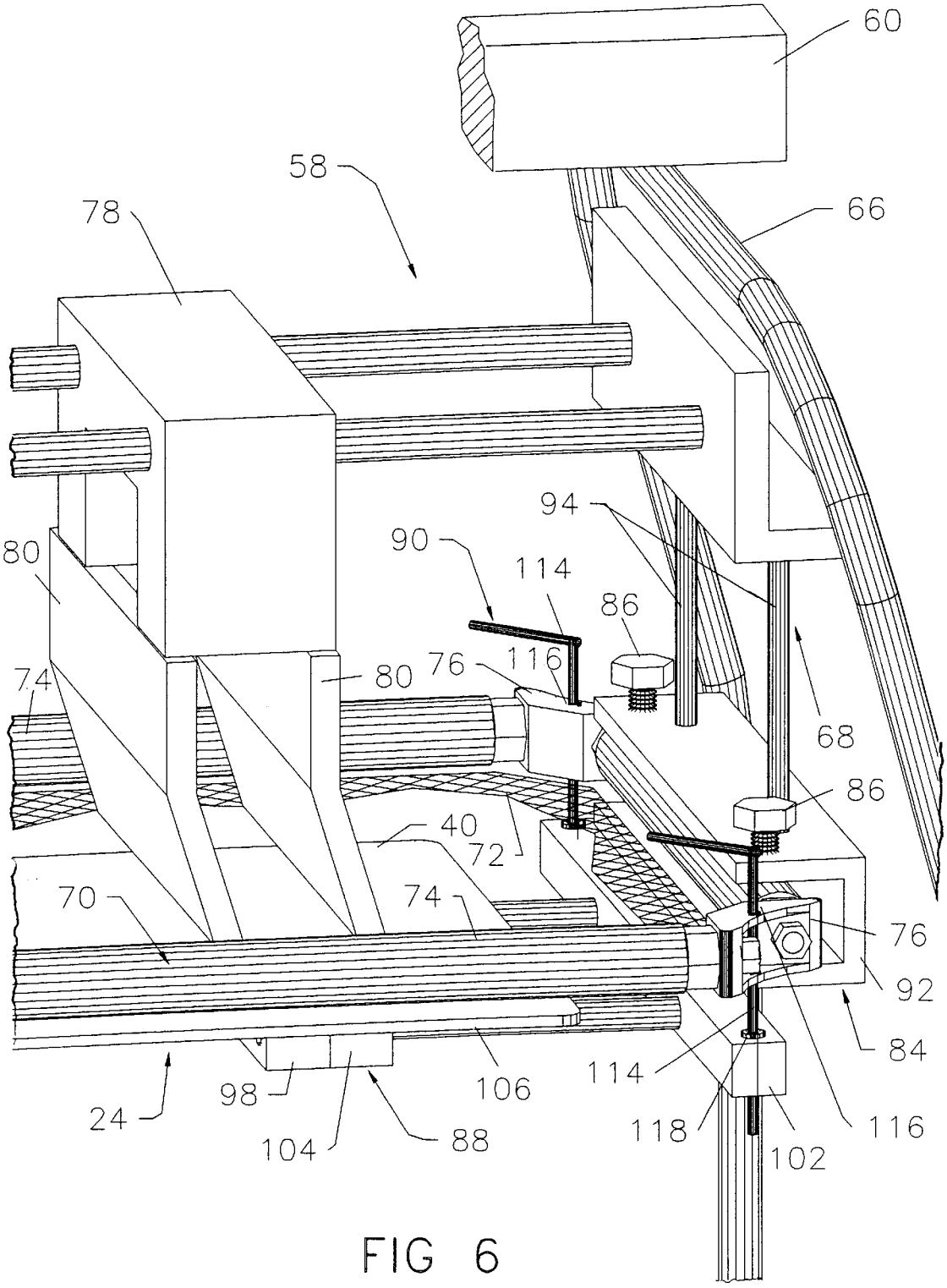
FIG. 6 is an enlarged fragmentary perspective view of one print station of the printer showing a printer work pallet at the station mounting a two-registration-point pallet attachment tool of this invention.
Figure 12:
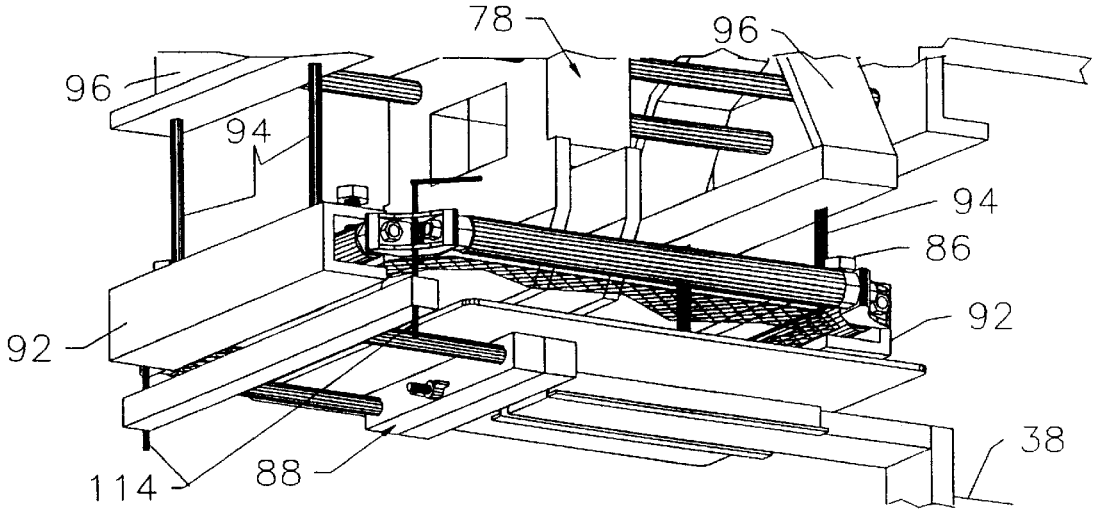
FIG. 12 is a view similar to FIG. 11 illustrating the manner in which the pallet attachment tool is used to register the screen frame with the printer work pallets.

The selected work pallet 40 and its pallet attachment tool 88 are held in their elevated registration position at each print station for a period of time during which the respective screen frame 70 is adjusted edgewise in its holder 68 to align the registration holes 116 in the frame with the registration holes 118 in the pallet attachment tool. The registration pins 114 are then inserted through the aligned frame and attachment holes, as shown in FIGS. 6 and 12 to precisely positively register, that is precisely positively align, the frame with the pallet attachment tool. It will be observed in FIGS. 6 and 12 that the front frame support channel 92 is sized to provide ample clearance for insertion of the registration pins through the aligned registration holes. This registration of the screen frame with the pallet attachment tool also obviously registers the frame with the selected work pallet 40.

At this point, the clamp screws 86 on the frame holder support 84 are tightened to firmly clamp the screen frame 70 to the support and thereby secure the frame in its registered position. The registration pins 114 are then removed, and the selected work pallet and pallet attachment tool are lowered and rotated to the next print station 28 where the above registration procedure is repeated. An important advantage of the present registration means resides in the fact that the registration holes 116, 118 are located at the front of each print head 58 where they are easily accessible for insertion and removal of the registration pins 114.

After all of the screen frames 70 have been registered in the manner described above, the printer is conditioned for normal printing operation by removing at least the front part 99 of the pallet attachment tool 88 from the selected work pallet 40. The pallet attachment tool mounting block 98 may be left on the selected pallet to facilitate later registration of the printer. A work piece W to be printed is fixed to the upper side of each work pallet 40 in proper alignment or registration with the pallet. The work pieces are secured to the pallets in any convenient way. The printer 20 is then operated in its normal printing mode to imprint the printing screen images on the work pieces in succession to produce a composite multicolor image on each work piece.

The image on each printing screen 72 is registered with, that is located in a predetermined position relative to, its screen frame 70 and, more importantly, relative to the frame registration holes 116 which provide registration references on the frame. This registration of each screen image with its frame registration holes may be accomplished in any convenient way, as by utilizing, in the manner explained earlier, a vacuum table having registration pins engagable in the frame registration holes 116. Each work piece W is registered or aligned with its work pallet in the same way as in a conventional carousel printer. The registration holes 118 in the pallet attachment tool 88 provide registration references and are situated on the pallet attachment tool in positions such that when these registration holes are aligned with the registration holes 116 in a screen frame 70, the image on the printing screen mounted on the frame is precisely registered or aligned with a work piece fixed in the proper registered position on the selected pallet. Since all of the work pallets 40 occupy identical, though circumferentially spaced, positions on the turret 24, registration of each screen image with the selected work pallet in the manner explained above is effective to precisely register each screen image with all of the work pallets and hence with the work pieces on all the pallets.

Figure 13:
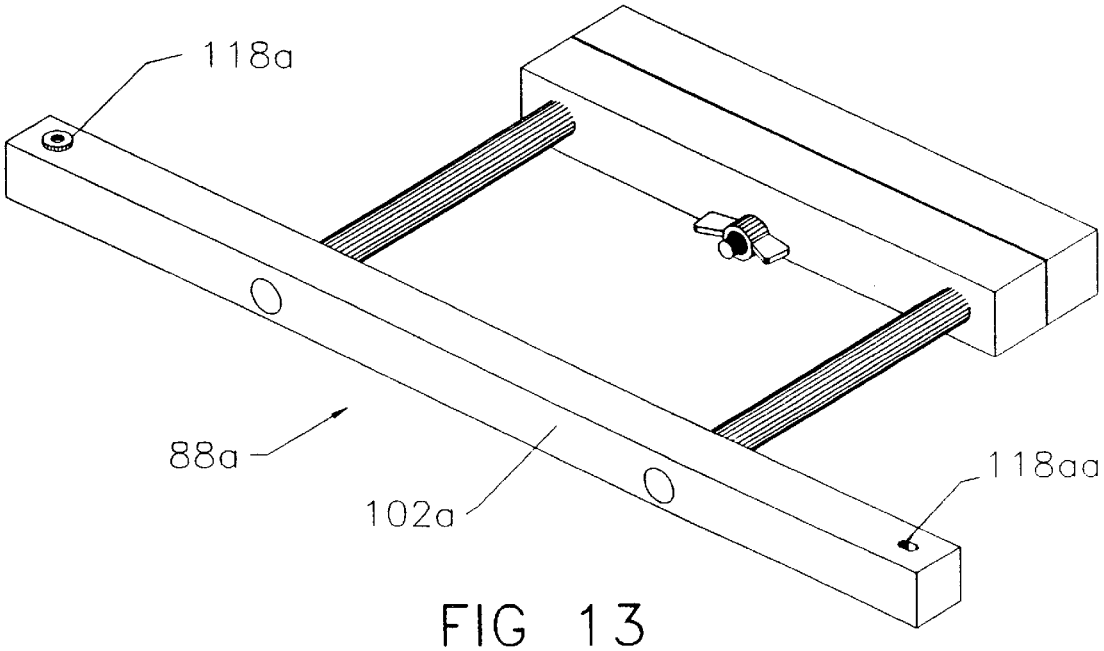
FIGS. 13 and 14 illustrate two modified two-registration-point pallet attachment tools according to the invention.
Figure 14:
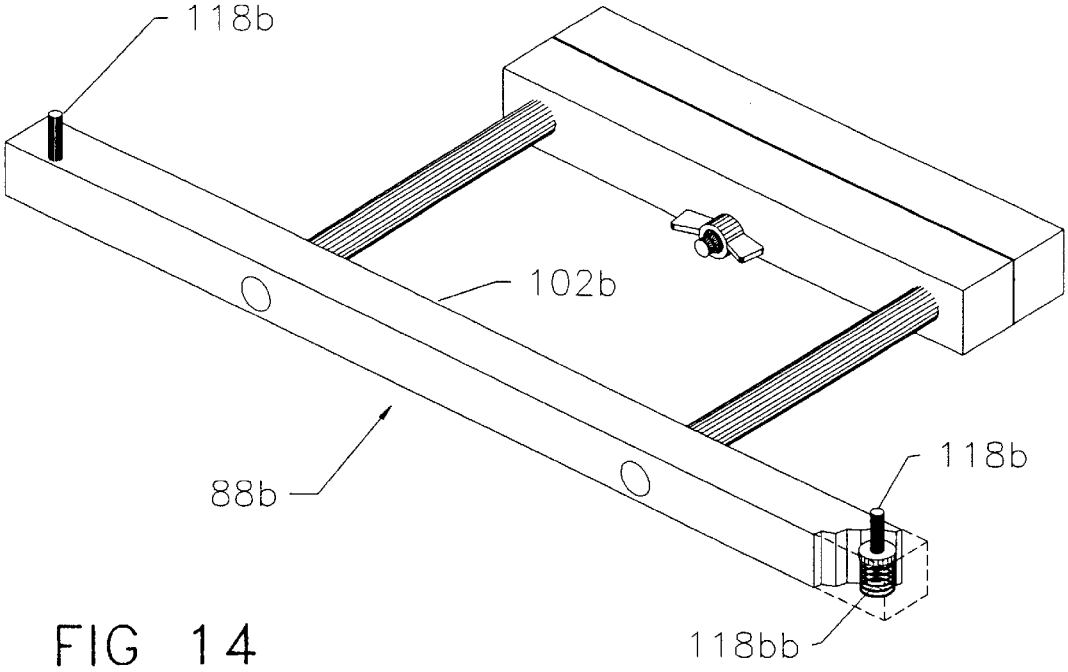

FIGS. 13 and 14 illustrate modified pallet attachment tools 88*a*, 88*b* each of which may be used in place of the pallet attachment tool 88. The modified pallet attachment tools are identical to the pallet attachment tool 88 except in the following respects. The front bar 102*a* of the pallet attachment tool 88*a* has a circular registration hole 118*a* and an elongated registration hole 118*aa*. The circular registration hole 118*a* is sized to slidably receive a registration pin 114, as in the pallet attachment tool 88. The elongated registration hole 118*aa* is sized in width transverse to the front bar 102*a* to slidably receive a registration pin 114 and is elongated lengthwise of the front bar to accommodate a range of spacings between the registration holes 116 on the screen frames 70. The modified pallet attachment tool 88*a* is used in the same manner as the pallet attachment tool 88.

The front bar 102*b* of the pallet attachment tool 88*b* of FIG. 14 has a pair of upstanding registration pins 118*b* in place of and located at the same positions as the registration holes 118 in the front attachment bar 102 of attachment 88. These registration pins could be rigidly joined to the front bar 102*b*. Preferably, however, the pins 118*b* are axially slidable in the front bar and are resiliently urged outwardly by springs 118*bb*. The modified pallet attachment tool 88*b* is used in much the same way as the pallet attachment tool 88 except that registration pins 114 are not used, and during registration, each screen frame 70 is adjusted edgewise in its support 84 until the pallet attachment tool pins 118*b* engage in the frame registration holes 114.

Figure 15:
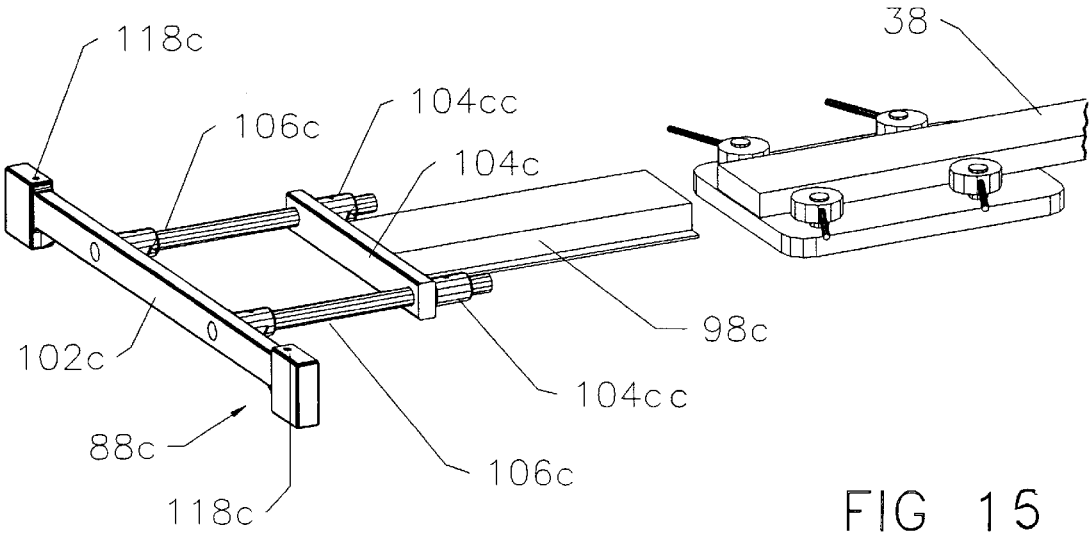
FIG. 15 illustrates a two-registration-point pallet replacement tool according to the invention which may be used in place of the pallet attachment tools of FIGS. 7, 8, 13, and 14.
Figure 16:
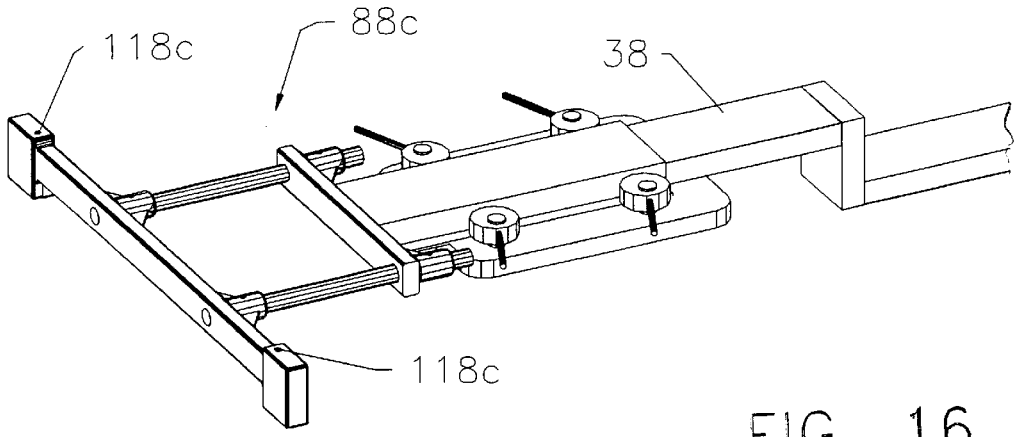
FIG. 16 illustrates the pallet replacement tool of FIG. 15 mounted on a work support of the printer.
Figure 17:
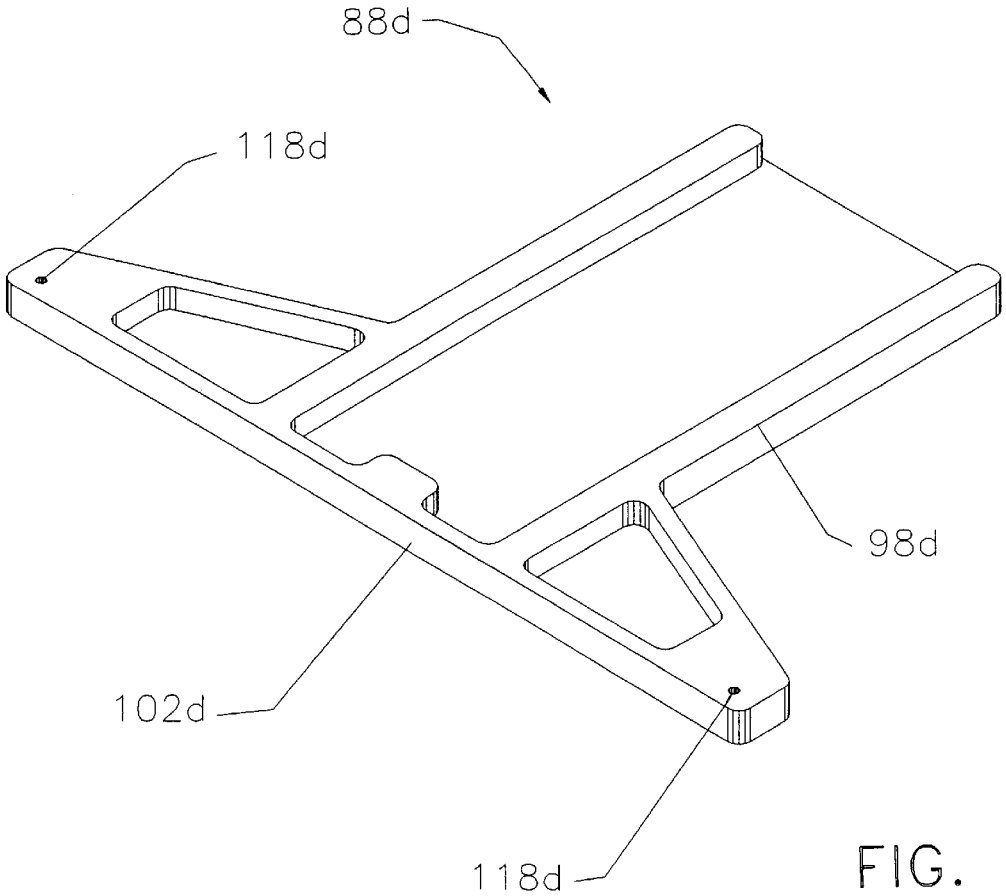
FIG. 17 illustrates a modified two-registration-point pallet replacement tool according to the invention.

FIGS. 15–17 illustrate pallet replacement tools 88*c* and 88*d* according to the invention which may be used in the registration means 82 of the invention in place of the pallet attachment tools described to this point. The pallet replacement tool 88*c* comprises front and rear bars 102*c*, 104*c* rigidly joined by connecting rods 106*c*. The rear bar 104*c* may be adjustable on the rods 106*c* to adjust the spacing between the bars 102*c*, 104*c* and secured in position by means 104*cc* on the rear bar. Rigidly joined to the rear side of the rear bar 104*c* midway between its ends and extending rearwardly from the rear bar is a channel 98*c* to be secured to a pallet support arm 38 in the same manner as the channels 44 on the printer work pallets 40. The pallet replacement tool 88*c* is adapted to be mounted on a selected pallet support arm 38 of the printer turret 24 in place of the work pallet 40 on the arm, as shown in FIG. 16. The front bar 102*c* of the pallet replacement tool 88*c* has registration holes 118*c*.

The pallet replacement tool 88*c* is used in essentially the same way as the pallet attachment tool 88 to register the printer screen frames 70 during operation of the printer in its registration mode. Thus, during registration, the pallet attachment tool is rotated to the print stations 28 in succession and elevated at each station into close proximity to or contact with the respective screen frame. The frame is then adjusted to align its registration holes 116 with the registration holes 118*c* in the pallet attachment tool and thereby permit insertion of the registration pins 114 through the aligned holes. The remainder of the registration procedure and normal printer operation are the same as described earlier.

The pallet replacement tool 88*d* of FIG. 17 comprises a one piece casting including a front bar portion 102*d* and a rear channel portion 98*d*. In the ends of the front bar portion 102*d* are registration holes 118*d*. The pallet attachment tool 88*d* is adapted to be mounted on a pallet support arm 38 of the printer turret 24 in the same manner as the pallet replacement tool 88*c* and is used in the same way as the tool 88*d* to register the printer screen frames 70.

It is evident from the description to this point that all of the inventive embodiments described thus far provide two points of registration for each screen frame 70. These two registration points are located along the front edge of each frame 70 at the two frame registration holes 116 (FIG. 6). While such two point registration is capable of providing accurate frame registration, under certain circumstances two point registration may permit some slight frame distortion or displacement and hence loss of precise frame registration during clamping of the frames to the print stations by tightening of the frame clamp screws 86. FIGS. 18–29 illustrate presently preferred embodiments of the invention which provide three point registration of each screen frame. This three point registration achieves more secure fixed positioning of the screen frames during clamping of the frames to the print stations following registration of the frames and thereby more accurate pin registration of the frames.

Referring first to FIGS. 18–23, there are illustrated three-point-registration means 200 according to the invention for pin registering three-registration-point screen frames 202 according to this invention directly with the work pallets 40 of the carousel screen printer 20 of FIGS. 1–3. This three point registration means comprises the three-registration-point screen frames 202, a three point registration device 204, and alignment means in the form of registration pins 206 insertable through registration holes in the screen frames 202 and the registration device 204.

Except for the differences noted below, the three-registration-point screen frames 202 are identical to the two-registration-point screen frame 70 described earlier. Screen frame 202 includes rollers 208 joined at their ends by corner brackets 210 to form a rigid open rectangular frame structure. A printing screen 212 is secured along its edges to the rollers and stretched edgewise across the normally lower side of the frame. One difference between the screen frame 202 and the earlier screen frame 70 resides in the fact that the corner brackets 210 of frame 202 have lower, relatively wide arcuate flanges 214. Another difference is that in the earlier frame 70, only two corner brackets 76 contain registration holes 116, whereas three of the corner brackets 210 of frame 202 contain registration holes 216 in their lower bracket flanges 214.

The illustrated three-registration-point registration device 204 is a pallet replacement tool. This three-registration-point pallet replacement tool, like the two-registration-point pallet replacement tools described earlier, is designed to be mounted on a selected work support arm 38 (registration support arm) of the carousel printer 20 in place of the work support pallet 40 on the selected arm during operation of the printer in its registration mode. Pallet replacement tool 204 comprises a rectangular mounting plate 218 which is removably secured to the registration support arm 38 by means 220 identical to the means, described earlier in connection with FIGS. 4 and 5, which secure the work support pallets 40 to the printer support arms.

Rigidly secured to and depending below the under side of the plate 218 along front and rear edges of the plate are flanges 222, 224. A connecting rod 226 extends slidably through these flanges along one side edge of the plate 218. Rigidly fixed to the front end of the rod 226 and extending laterally of the rod along the front edge of the plate 218 is a front registration bar 228. A pair of guide rods 230 spaced along and rigidly fixed to the registration bar 228 extend rearwardly from the bar and slidably through the front plate flange 222. The front registration bar 228 is fixed in position relative to the plate 218 by set screws 232 threaded in the front plate flange 222 and engaging the registration bar guide rods 230. Extending laterally of and adjustable along the rear end of the connecting rod 226 is a rear registration bar 234. A guide rod 236 is rigidly fixed to the rear registration bar 234 and extends slidably through the rear plate flange 224 parallel to the connecting rod 226. Threaded in the rear registration bar 234 is a set screw 237 for releasably securing this bar in fixed position along the connecting rod 226. Extending vertically through and opening through the upper sides of the front registration bar 228 and the rear registration bar 234 at the ends of the front bar and the outer end of the rear bar are registration holes 238.

The front and rear registration bars 228, 234 and the rods 226, 230, 236 together form a three-point registration part 240 which is adjustable in the fore and aft direction of the pallet replacement tool 204 relative to the plate 218 of the tool. The rear registration bar 234 of this adjustable registration part 240 is adjustable along the rod 226 to adjust the fore and aft spacing between the front and rear registration holes 238. The manner in which the rear registration bar 234 and the part 240 are adjusted is explained below. The registration holes 238 in the front registration bar 228 have a fixed spacing.

Figure 22:
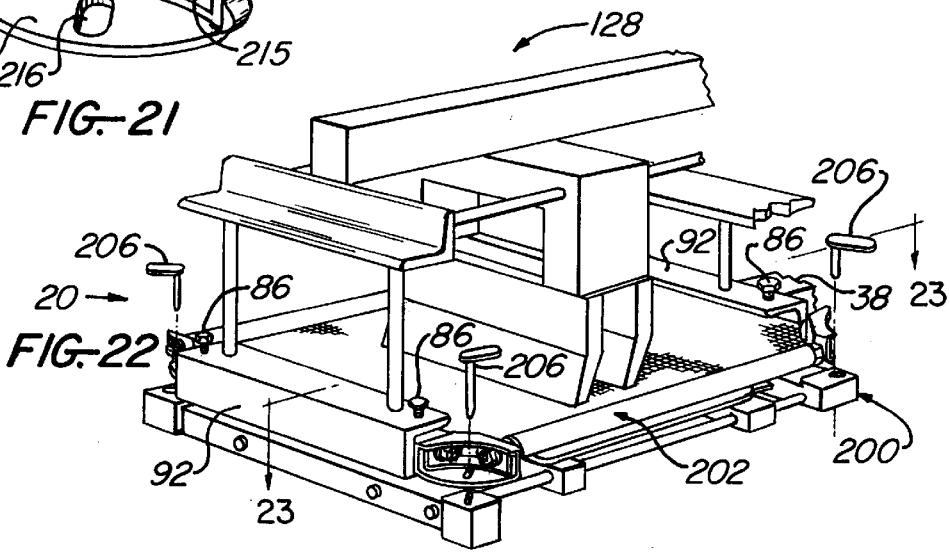
FIG. 22 is an enlarged perspective view of one print station of a carousel screen printer illustrating the manner in which a three-registration-point screen frame according to the invention is pin registered at the print station.
Figure 23:
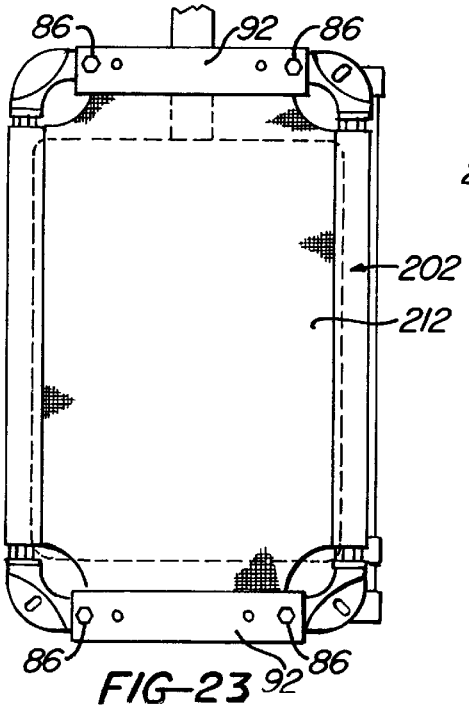
FIG. 23 is a view taken on line 23—23 in FIG. 22.

Operation of the carousel printer 20 in its registration mode with the three point registration means 200 of the invention is much the same as described earlier in connection with the earlier two-registration-point embodiments of the invention. Thus, in the three-point registration mode of the printer, the screen frame clamp screws 86 at each print station 128 are loosened, and a three-registration-point screen frame 202 is positioned at each print station with the ends of the frame situated within the frame supporting channels 92 at the respective station, as illustrated in FIGS. 22 and 23 (only one print station and screen frame shown in FIGS. 22 and 23). One work support pallet 40 of the printer is replaced by the three-registration-point pallet replacement tool 204 with the front registration bar 228 of the replacement tool located at the outer end of the respective work support arm 38 (registration support arm), as shown.

The printer turret 24 is rotated stepwise through its printing positions with the turret work table 32 in its lower retracted position to locate the lowered pallet replacement tool 204 at the print stations in succession. The turret work table 32 is elevated while the pallet replacement tool 204 is situated at each print station 128 to raise the tool to its registration position of FIG. 22. In this position, the tool plate 218 is close to or in contact with the underside of the screen frame 202 at the respective print station. Registration pins 206 are now inserted through the three screen frame registration holes 216 into the three registration holes 238 in the pallet replacement tool 204 to pin register the frame to the tool. The print station clamp screws 86 are then tightened to firmly clamp the screen frame in its registered position, and the pallet replacement tool is rotated to the next print station where the above screen frame registration procedure is repeated. After all of the screen frames 202 have been registered, the pallet replacement tool 204 is removed from the printer and replaced by a normal printer work pallet 40.

This three point registration procedure is superior to the two point registration procedure of the earlier described inventive embodiments for the reason that each registered three-registration-point screen frame 202 is fixed at both ends to the pallet replacement tool 204, and thereby held more firmly in its pin registered position relative to the respective print station 128 of the carousel printer 20, during clamping of the frame in its registered position by the print station clamp screws 86. In the earlier two-registration-point embodiments of the invention, each screen frame 40 is fixed at its front end only by two registration pins during clamping of the frame in its registered position by its clamp screws 86. The rear end of the frame is unrestrained with the result that it may be possible in some situations for the frame to shift or twist slightly while it is being clamped.

As described to this point, the three point pin registration procedure is essentially identical to the two point registration procedure described earlier except for the following differences. First, of course, screen frame registration occurs at three points rather than at two points. Secondly, the registration holes 216 in each three-registration-point screen frame 202 are slots certain of which are disposed at oblique angles relative to one another. The slots are sized in width to slidably receive the registration pins 206 between the longitudinal sides of the slots. The registration holes 238 in the pallet replacement tool 204 are circular holes sized to slidably receive the registration pins 206. According to this invention, the angled registration slots 216 in the screen frames 202 are uniquely arranged to reduce the dimensional tolerances required in the fabrication and assembly of the frames and yet facilitate registration of each frame with the pallet replacement tool 204 in the registration mode of the printer 20 by insertion of the registration pins 206 through the aligned registration slots/holes 216, 238 in the pallet replacement tool and screen frame. The manner in which the angled frame registration slots accomplish this will now be described in connection with FIGS. 20A–20C.

It will be recalled from the earlier description that the image registration procedure involving a vacuum table for registering a film positive transparency image relative to a three-registration-point screen frame 202 according to this invention, preparatory to reproducing a corresponding printable image on the frame screen 212, utilizes three registration points on the vacuum table which are aligned with three registration points on the screen frame. In the case of the illustrated screen frame 202, the registration points on the frame are its registration slots 216 which are disposed at approximately 45 degree angles relative to the adjacent sides of the screen frame, and the registration points on the vacuum table are registration pins engagable in the frame slots.

Figure 20:
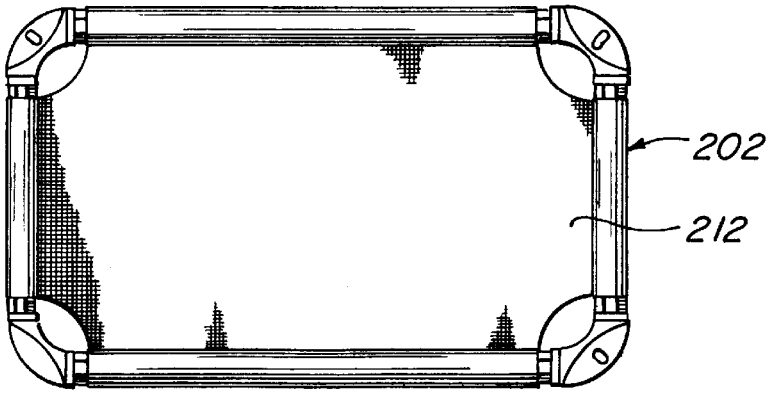
FIG. 20 is a top plan view of a three-registration-point screen frame according to the invention for use with the three-registration-point pallet replacement tool of FIGS. 18 and 19.
Figure 20A:
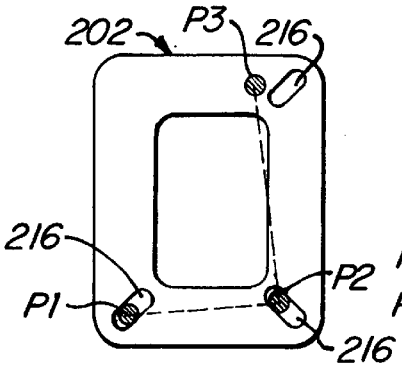
FIGS. 20A, 20B, 20C are enlarged fragmentary views of the screen frame in FIG. 20 showing only corner portions of the frame and illustrating certain novel and beneficial aspects of the registration procedure according to the invention.
Figure 20B:
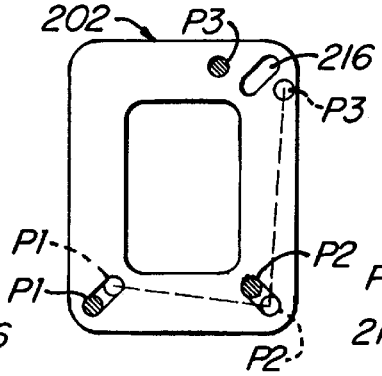
Figure 20C:
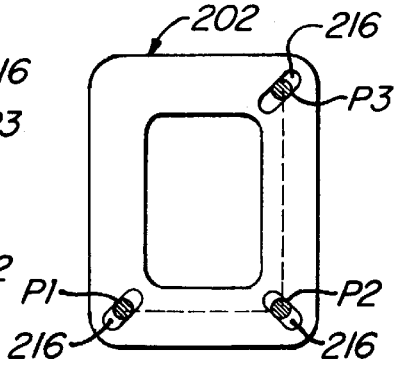
Figure 21:
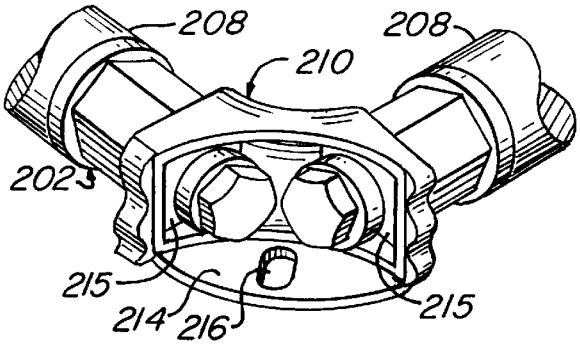
FIG. 21 is an enlarged fragmentary perspective view of one corner of the screen frame in FIG. 20.

Refer now to FIGS. 20A, 20B, 20C illustrating in diagrammatic fashion a three-registration-point screen frame 202 according and elements P1, P2, P3. At this point, regard these elements as representing the three registration pins of the vacuum table on which the frame is registered with a film positive image (not shown) on the table. These pins are sized to fit slidably between the longitudinal sides of the frame slots 216 and are fixed in positions corresponding approximately to the longitudinal centers of the frame slots, whereby the frame 202 can be placed over the pins with the pins extending through all three slots only in the frame position shown in FIG. 20C. In other words, the three registration pins P1, P2, P3 and the three angled frame slots 216 are arranged in a manner such that engagement of all three pins in the frame registration slots 216 locates the screen frame 202, and more importantly its registration slots, in a predetermined registered position relative to the registration pins.

Refer next to FIGS. 20A and 20B in which the screen frame 202 and the registration pins P1, P2, P3 are relatively positioned so that only pins P1 and P2 engage in their frame slots 216. These latter frame slots now permit limited back and forth edgewise movement of the frame 202 about the two engaged registration pins P1, P2, as shown in FIG. 20B. During this back and forth frame movement, the lower frame slots 216 containing the registration pins P1, P2 move endwise back and forth a small distance relative to the latter pins, as shown in FIG. 20B. The upper frame slot 216 moves back and forth across the registration pin P3 and through the position of FIG. 20*c* wherein the upper frame slot 216 is aligned with the upper registration pin P1. The upper pin can then enter the upper frame slot to fix the frame in its registered position relative to all three pins. As explained below, the pallet replacement tool 204 is adjusted so that its three registration holes 238 occupy precisely the same relative positions as the registration pins P1, P2, P3 and hence the same relative positions as the longitudinal centers of the frame registration slots 216.

The angled screen frame registration slots 216 facilitate registration of the screen frame 202 at each print station 128 of the printer 20 with the pallet replacement tool 204 in the registration mode of the printer 20. This frame registration procedure at each print station will now be described also with reference to FIGS. 20A–20C. In this case, regard these figures as illustrating the screen frame 202 in FIGS. 22 and 23 and the reference characters P1, P2, P3 as representing the three registration holes 238 in the pallet attachment tool 204 in FIGS. 22 and 23.

While the pallet replacement tool 204 is situated in its registration position at each print station 128 of the carousel printer 20 during the registration mode of the printer, two of the registration slots 216 in the screen frame 202 at the respective print station (in this case the front frame registration slots which are the lower slots in FIGS. 20A–20C) are first aligned with the corresponding replacement tool registration holes 238 (P1, P2), as shown in FIG. 20A. Registration pins 206 are inserted through these aligned front registration slots and holes. The screen frame 202 is then joggled or moved edgewise back and forth about the two inserted registration pins (FIG. 20B) to align the third rear frame registration slot 216 with the third pallet replacement tool registration hole 238 (P3), as shown in FIG. 20C. A third registration pin 206 is then inserted through the latter aligned third registration slot and hole. The screen frame 202 is then precisely pin registered to the pallet replacement tool 204. From this description, it will be understood that the angled frame slots 216 facilitate insertion of the registration pins 206 through the corresponding frame slots and replacement tool registration holes 238 to pin register the screen frame 202 and reduce the dimensional tolerances required in the fabrication and assembly of the frames.

It is evident from the foregoing description that while the use of angled registration slots 216 in the screen frame 202 permit edgewise joggling of the frame about two registration pins 206, as just described, there is only one position of the frame relative to the pallet replacement tool 204 (the registered position of the frame) in which all three registration pins 206 can be inserted through the frame slots and tool holes. Accordingly, the described three point registration procedure locates the screen frame at each print station 128, and more importantly the image on the frame screen 212, in a precise registered position relative to the respective print station and hence relative to a work piece supported in printing position on a printer work pallet 40 at the respective station during printing operation of the printer.

Other angled slot arrangements may be utilized on the screen frames 202. That is to say, the frame slots 216 may be angled in any way which (a) permits edgewise joggling of a frame in the manner described and illustrated in FIG. 20B when registration pins 206 are inserted through two of the screen frame slots 216 and (b) provides one and only one relative position of the screen frame and the pallet replacement tool 204 in which registration pins 206 can be inserted through all three registration holes/slots. This condition exists when (a) at least two of the frame slots are disposed at an oblique angle relative to one another so that the frame can move edgewise about registration pins inserted through these two angled slots and two registration holes 238 in the pallet replacement tool, as illustrated in FIG. 20B, (b) the path of relative movement of the third registration hole in the pallet tool respect to the frame during this edgewise movement of the frame intersects the third frame slot, and (c) this path does not parallel the third slot. In the illustrated screen frame 202, the bottom right hand slot is disposed at oblique angles relative to the remaining two slots, and these two remaining slots parallel one another.

As noted earlier, the pallet replacement tool 204 includes an adjustable part 240 which is adjustable in the fore and aft direction of the tool relative to the tool mounting plate 218. This part is adjusted and fixed in position to locate its two front registration holes 238, and thereby the front ends of the screen frames 202, in the proper positions at the print stations 128. The rear registration bar 234 of the pallet replacement tool is adjustable fore and aft of the tool relative to the front registration bar 228 to adjust the spacing, in the fore and aft direction of the pallet replacement tool, between the two front registration holes 238 and the rear registration hole 238.

Figure 18:
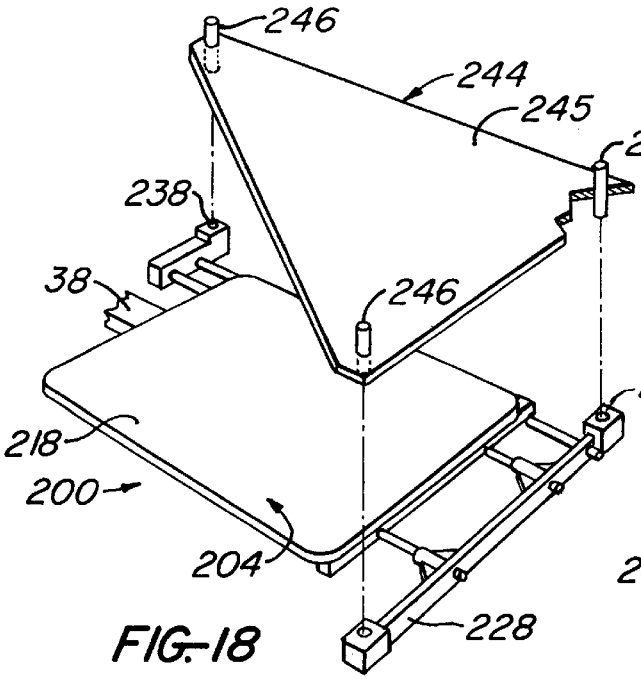
FIG. 18 is a perspective view of the upper side of a three-registration-point pallet replacement tool according to the invention and showing a calibration tool according to the invention which is used in conjunction with the three-registration-point pallet replacement tool.
Figure 19:
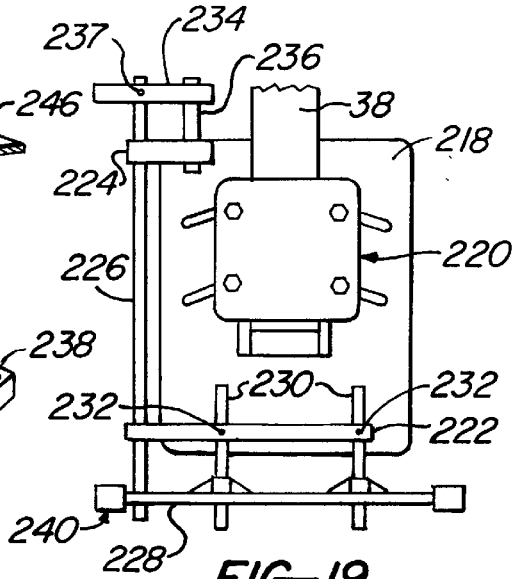
FIG. 19 is a bottom view of the pallet replacement tool in FIG. 18.

The rear registration bar 234 is set using the calibration tool 244 in FIG. 18. This calibration tool comprises a plate 245 mounting three fixed alignment pins 246. These alignment pins are sized to fit slidably within the registration holes 238 in the pallet replacement tool 204. The alignment pins 246 are located in the same relative positions on the plate 245 as the earlier discussed registration pins (P1, P2, P3 FIGS. 20A–20C) are located on the vacuum table used to register the screen frame 202 with a film positive on the table. The rear registration bar 234 on the pallet replacement tool 204 is set to the proper position for the particular screen frames to be registered by coaxially aligning the two front alignment pins 246 of the calibration tool 244 with the two front registration holes 238 in the pallet replacement tool 204 and then adjusting the rear registration bar 234 of the replacement tool to coaxially align its registration hole 238 with the rear alignment pin 246 on the calibration tool.

Figure 24:
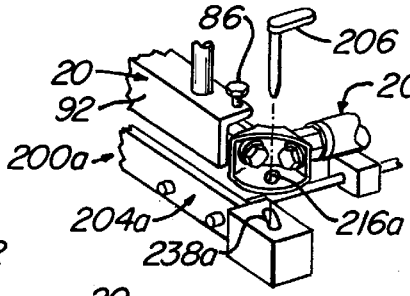
FIGS. 24 and 25 illustrate two different modified registration hole arrangements for the three-registration-point pallet replacement tool and screen frame in FIGS. 20–23.
Figure 25:
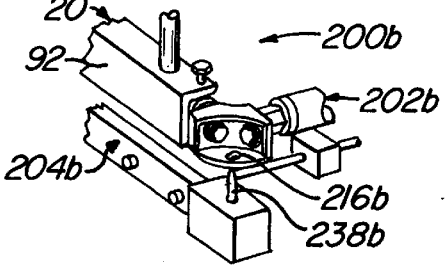

FIGS. 24 and 25 illustrate two modified registration means 200*a*, 200*b* according to the invention. In FIG. 24, the registration holes 216*a* in each screen frame 202*a* are circular holes. The registration holes 238*a* in the pallet replacement tool 204*a* are angled slots. The registration procedure of the invention involving the registration means 200*a* of FIG. 24 is the same as described above in connection with FIGS. 18–23. In FIG. 25, the registration holes 216*b* on each screen frame 202*b* are angled slots like the slots 216 in the screen frames 202. The registration points on the pallet replacement tool 204*b* are fixed registration pins 236*b* engagable in the screen frame slots 216*b*. The registration procedure of the invention involving the registration means 200*b* of FIG. 24 is essentially the same as described above in connection with FIGS. 18–23 except that the registration pins 206 are not used, and the screen frame 202*b* is fixed to the pallet replacement tool 204*b* by sliding the frame across the tops of the fixed registration pins 238*b* to engage the pins in the frame slots 216*b*.

Figure 26:
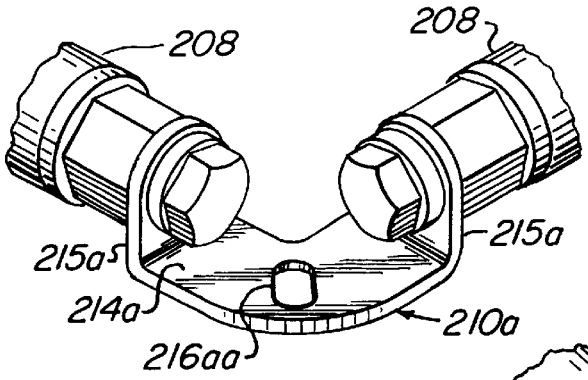
FIGS. 26 and 26A are perspective views of modified corner brackets for the screen frame in FIG. 20.
Figure 26A:
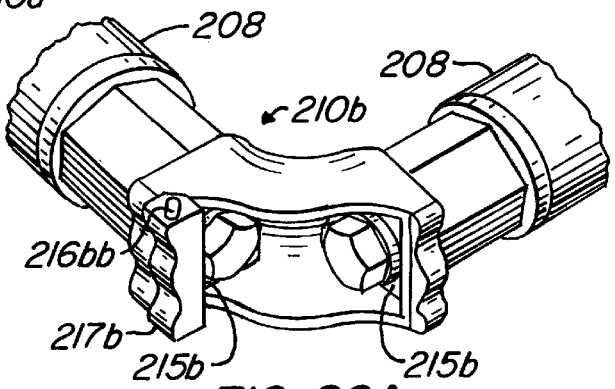

FIGS. 26 and 26A illustrate modified corner brackets 210*a*, 210*b* according to the invention for use on the screen frames 202. Bracket 210*a* includes a flat generally L-shaped portion 214*a* containing a registration slot 216*aa* and upstanding flat apertured flanges 215*a* at the ends of the bracket portion 214*a* for attachment to the frame rollers. Bracket 210*b* is similar to the frame brackets 210 except that the bracket slot 216*bb* enters the upper side of a boss 217*b* rigid on the bracket.

Figure 27:
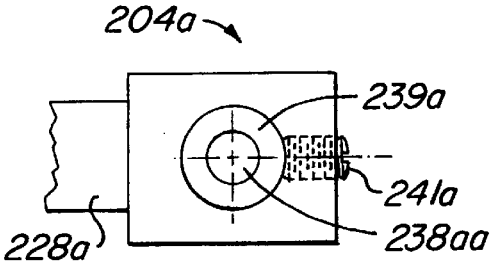
FIGS. 27 and 28 illustrate modified registration hole constructions for the invention.
Figure 28:
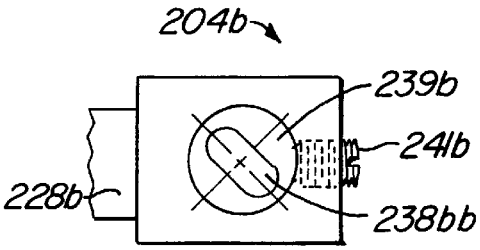

FIGS. 27 and 28 illustrate, in fragmentary fashion, modified pallet replacement tools 204*a*, 204*b* according to the invention in which the registration holes in the tools are provided by hardened inserts 239*a* and 239*b*, respectively. FIG. 27 shows the insert 239*a* in one end of the front registration bar 228*a* of the tool 204*a*. Insert 239*a* contains a registration hole 238*bb* and is fixed in position by a set screw 241*a*. FIG. 28 shows a modified insert 239*b* in one end of the front registration bar 228*b* of the tool 204*b*. Insert 239*b* contains a registration slot 238*b* and is rotatably adjustable to change the angle of the insert slot 238*b*. The insert is fixed in position by a set screw 241*b*.

Figure 29:
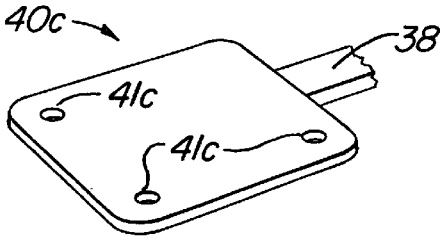
FIG. 29 is a perspective view of the upper side of a combination carousel printer work support pallet and registration device according to the invention.

FIG. 29 illustrates a registration pallet 40*c* according to the invention for use as both a printer work pallet and a three point registration device in place of the pallet replacement tool 204. This registration pallet is identical to the conventional printer work pallet 40 illustrated in FIGS. 1–5 except that the registration pallet has three registration holes 41*c* for receiving the registration pins 206. These registration holes have the same relative positions as the registration pins (P1, P2, P3 in FIGS. 20A–20*c*) on the vacuum table on which the screen frames 202 are registered with the film positive on the table and the same relative positions as the alignment pins 246 on the calibration tool 244. Operation of the carousel printer 20 in its registration mode with the registration pallet 40*c* is identical to the printer operation with the pallet replacement tool 204 except that each screen frame is registered with the registration pallet by inserting the registration pins 206 through the frame registration holes into the registration pallet holes 41*c*. Registration pallet 40*c* can remain on the printer after completion of screen frame registration to serve as a work support pallet for the printer. The pallet 40*c* may also be removed and used as a pallet replacement tool for screen frame registration. In contrast with the pallet replacement tool 204 of FIG. 18, which is adjustable for re-calibration the tool 40*c* of FIG. 29 is not adjustable. This is preferred by some users who wish to eliminate the re-calibration requirement where possible.

It will be recalled that the pallet replacement tool 204 has an adjustable part 240. From the earlier description of this part, it is evident that the part 240 may be removed from the plate 218 of the pallet replacement tool. According to the present invention, the plate 218 may be used as a normal work pallet for the printer which remains on the printer at all times. The removable part then serves as a pallet attachment tool which may be mounted on the pallet 218 to pin register the printer screen frames and then removed from the latter pallet to permit use of this pallet as a normal printer work pallet.

An important feature of the invention resides in the fact that frame corner brackets 210, 210*a*, 210*b* of the invention may be retrofitted on a conventional screen frame, such as the roller frame in U.S. Pat. No. 5,018,442, in place of the conventional frame corner brackets, to adapt such frame to use in the present invention. To this end, the bracket bodies are generally L-shaped and have end portions (i.e. bracket end portions 215 in FIG. 21, end portions 215*a* in FIG. 26, and end portions 215*b* in FIG. 26A) containing holes (not shown) on mutually perpendicular axes like for receiving the roller end shafts in the same manner as described in connection with the frame rollers in U.S. Pat. No. 5,018,442. The brackets 210, 210*a*, 210*b* are removably secured to the rollers by nuts on the roller shafts in the same manner as described in U.S. Pat. No. 5,018,442.

The inventor claims:

1. In a screen printing apparatus comprising (A) a print head including a screen frame mounting a printing screen bearing a screen image to be printed, a screen frame support removably supporting said frame for edgewise adjustment of said frame relative to said print head, and frame securing means for releasably securing said frame in fixed position relative to said print head, (B) work support means including a work support for supporting a work piece to be printed, and (C) means for effecting relative movement of said frame support and said work support to and from a printing position wherein said work support is aligned with said print head and is disposed in printing relation to said screen frame, the improvements comprising:

registration means for registering said frame directly to said work support at three mutually spaced registration points arranged in a triangular pattern on each of said frame and work support when said frame is released for edgewise adjustment relative to said print head and said work support is located in a registration position wherein the work support is aligned with said print head, and wherein said registration means comprises a registration device on said work support, and alignment means directly engagable between said screen frame and said registration device at said registration points, respectively, for aligning said frame in a predetermined registered position relative to said registration device wherein said frame occupies a certain position relative to said print head and said frame occupies a predetermined registered position relative to said work support when said work support occupies said printing position, and said frame securing means are operative to secure said frame in said certain position relative to said print head.

2. The subject matter of claim 1 wherein:

said frame is rectangular in shape, and said registration points are located at three corners of said frame.

3. The subject matter of claim 2 wherein:

said registration points comprise diagonal slots in one of the following: said frame and said work support, and said alignment means comprise registration pins insertable through said slots.

4. In a screen printing machine comprising (A) a plurality of print heads each including a screen frame mounting a printing screen bearing a screen image to be printed, a screen frame support for removably receiving said screen frame and supporting said frame for edgewise adjustment of said frame relative to the respective print head, and frame securing means for releasably securing said frame in fixed position relative to the respective print head, (B) work support means including a plurality of work supports for supporting work pieces to be printed, and (C) means for relatively moving said print heads and said work supports to align the work supports with the print heads in succession and effect relative movement of the work supports to successive printing positions wherein each work support is aligned with a print head and is disposed in printing relation to the screen frame of the respective print head, the improvements comprising:

registration means for registering said screen frames to said work supports by registering each screen frame directly to a selected work support at three mutually spaced registration points arranged in a triangular pattern on each frame and said selected work support when the selected work support is aligned with and occupies a certain registration position relative to the corresponding print head, and wherein said registration means comprises a registration device on said selected work support, and alignment means directly engagable with each screen frame and said registration device at said three registration points, respectively, when said selected work support occupies said registration position at the corresponding print head for aligning the respective frame in a predetermined registered position relative to said registration device wherein the respective frame occupies a registered position relative to the corresponding print head, and said frame securing means of each print head are operative to secure the corresponding screen frame in said registered position at the respective print head relative to said registration device.

5. The subject matter of claim 4 wherein:

each frame is rectangular in shape, and said registration points are located at three corners of each frame.

6. The subject matter of claim 5 wherein:

said registration points comprise diagonal slots in one of the following: each frame and each work support, and said alignment means comprise registration pins insertable through said slots.

7. In a screen printing apparatus comprising (A) a print head including a screen frame mounting a printing screen bearing a screen image to be printed, a screen frame support removably supporting said frame for edgewise adjustment of said frame relative to said print head, and frame securing means for releasably securing said frame in fixed position relative to said print head, (B) work support means including a work support for supporting a work piece to be printed, and (C) means for effecting relative movement of said frame support and said work support to and from a printing position wherein said work support is aligned with said print head and is disposed in printing relation to said screen frame, the improvements comprising:

registration means for registering said frame directly to said work support when said frame is released for edgewise adjustment relative to said print head and said work support is located in a registration position wherein the work support is aligned with said print head, and wherein said registration means comprises a registration device on said work support, and alignment means directly engagable between said screen frame and said registration device for aligning said frame in a predetermined registered position relative to said registration device wherein said frame occupies a certain position relative to said print head and said frame occupies a predetermined registered position relative to said work support when said work support occupies said printing position, said frame securing means are operative to secure said frame in said certain position relative to said print head, said alignment means comprise three registration pins directly engagable between said screen frame and said registration device and removably engagable in three registration holes, respectively, in one of the following: (a) said screen frame, (b) said registration device, and said registration holes comprise elongate slots including at least two non-parallel slots.

8. In a screen printing apparatus comprising (A) a print head including a screen frame mounting a printing screen bearing a screen image to be printed, a screen frame support removably supporting said frame for edgewise adjustment of said frame relative to said print head, and frame securing means for releasably securing said frame in fixed position relative to said print head, (B) work support means including a work support for supporting a work piece to be printed, and (C) means for effecting relative movement of said frame support and said work support to and from a printing position wherein said work support is aligned with said print head and is disposed in printing relation to said screen frame, the improvements comprising:

registration means for registering said frame directly to said work support when said frame is released for edgewise adjustment relative to said print head and said work support is located in a registration position wherein the work support is aligned with said print head, and wherein said registration means comprises a registration device on said work support, and alignment means directly engagable between said screen frame and said registration device for aligning said frame in a predetermined registered position relative to said registration device wherein said frame occupies a certain position relative to said print head and said frame occupies a predetermined registered position relative to said work support when said work support occupies said printing position, said frame securing means are operative to secure said frame in said certain position relative to said print head, said alignment means comprise three registration pins slidably engagable in three registration holes, respectively, in each of said screen frame and said registration device, and said registration holes in one of said frame and said registration device comprise elongate slots including at least two non-parallel slots.

9. In a screen printing apparatus comprising (A) a print head including a screen frame mounting a printing screen bearing a screen image to be printed, a screen frame support removably supporting said frame for edgewise adjustment of said frame relative to said print head, and frame securing means for releasably securing said frame in fixed position relative to said print head, (B) work support means including a work support for supporting a work piece to be printed, and (C) means for effecting relative movement of said frame support and said work support to and from a printing position wherein said work support is aligned with said print head and is disposed in printing relation to said screen frame, the improvements comprising:

registration means for registering said frame directly to said work support when said frame is released for edgewise adjustment relative to said print head and said work support is located in a registration position wherein the work support is aligned with said print head, and wherein said registration means comprises a registration device on said work support, and alignment means directly engagable between said screen frame and said registration device for aligning said frame in a predetermined registered position relative to said registration device wherein said frame occupies a certain position relative to said print head and said frame occupies a predetermined registered position relative to said work support when said work support occupies said printing position, said frame securing means are operative to secure said frame in said certain position relative to said print head, said alignment means comprise three registration pins mounted on one of the following: (a) said screen frame, (b) said registration device, said pins are slidably engagable in registration holes, respectively, in the other of said screen frame and said registration device after edgewise adjustment of said frame relative to said registration device to align said registration pins and holes, and said registration holes comprise elongate slots including at least two non-parallel slots.

10. The subject matter of claim 9 wherein:

said registration pins are mounted on said registration device.

11. In a screen printing machine comprising (A) a plurality of print heads each including a screen frame mounting a printing screen bearing a screen image to be printed, a screen frame support for removably receiving said screen frame and supporting said frame for edgewise adjustment of said frame relative to the respective print head, and frame securing means for releasably securing said frame in fixed position relative to the respective print head, (B) work support means including a plurality of work supports for supporting work pieces to be printed, and (C) means for relatively moving said print heads and said work supports to align the work supports with the print heads in succession and effect relative movement of the work supports to successive printing positions wherein each work support is aligned with a print head and is disposed in printing relation to the screen frame of the respective print head, the improvements comprising:

registration means for registering said screen frames to said work supports by registering each screen frame directly to a selected work support when the selected work support is aligned with and occupies a certain registration position relative to the corresponding print head, and wherein said registration means comprises a registration device on said selected work support, and alignment means directly engagable with each screen frame and said registration device when said selected work support occupies said registration position at the corresponding print head for aligning the respective frame in a predetermined registered position relative to said registration device wherein the respective frame occupies a registered position relative to the corresponding print head, said frame securing means of each print head are operative to secure the corresponding screen frame in said registered position at the respective print head, said work support means comprises a rotary turret having an axis of rotation and including a work table rotatable with the turret and movable along said axis, said work supports are mounted on and spaced circumferentially about said work table, said print heads are stationary and located at print stations spaced circumferentially about and located above said work table, said means for relatively moving said print heads and said work support comprises means for rotating said turret and worktable stepwise to rotate said work supports to said print stations in succession and for moving said work table along said axis in timed relation to stepwise rotation of the table to elevate said work supports to said printing positions at said print stations and to lower said work supports for rotation between print stations, said alignment means comprise three registration pins directly engagable between the screen frame at each print head and said registration device and removably engagable in three registration holes, respectively, in one of the following: (a) the screen frame at the respective print head, (b) said registration device, all while said selected work support occupies said registration position at the respective print head, and said registration holes comprise elongate slots including at least two non-parallel slots.

12. In a screen printing machine comprising (A) a plurality of print heads each including a screen frame mounting a printing screen bearing a screen image to be printed, a screen frame support for removably receiving said screen frame and supporting said frame for edgewise adjustment of said frame relative to the respective print head, and frame securing means for releasably securing said frame in fixed position relative to the respective print head, (B) work support means including a plurality of work supports for supporting work pieces to be printed, and (C) means for relatively moving said print heads and said work supports to align the work supports with the print heads in succession and effect relative movement of the work supports to successive printing positions wherein each work support is aligned with a print head and is disposed in printing relation to the screen frame of the respective print head, the improvements comprising:

registration means for registering said screen frames to said work supports by registering each screen frame directly to a selected work support when the selected work support is aligned with and occupies a certain registration position relative to the corresponding print head, and wherein said registration means comprises a registration device on said selected work support, and alignment means directly engagable with each screen frame and said registration device when said selected work support occupies said registration position at the corresponding print head for aligning the respective frame in a predetermined registered position relative to said registration device wherein the respective frame occupies a registered position relative to the corresponding print head, said frame securing means of each print head are operative to secure the corresponding screen frame in said registered position at the respective print head, said work support means comprises a rotary turret having an axis of rotation and including a work table rotatable with the turret and movable along said axis, said work supports are mounted on and spaced circumferentially about said work table, said print heads are stationary and located at print stations spaced circumferentially about and located above said work table, said means for relatively moving said print heads and said work supports comprises means for rotating said turret and worktable stepwise to rotate said work supports to said print stations in succession and for moving said work table along said axis in timed relation to stepwise rotation of the table to elevate said work supports to said printing positions at said print stations and to lower said work supports for rotation between print stations, said alignment means comprise three registration pins slidably engagable in three registration holes, respectively, in the screen frame at each print head and in said registration device while said selected work support occupies said registration position at the respective print head, and said registration holes comprise one of the following hole combinations (A), (B): (A) circular holes in the frame at each print head and elongate slots including at least two non-parallel slots in said registration device, (B) circular holes in said registration device and elongate slots including at least two non-parallel slots in the frame at each print head.

13. In a screen printing machine comprising (A) a plurality of print heads each including a screen frame mounting a printing screen bearing a screen image to be printed, a screen frame support for removably receiving said screen frame and supporting said frame for edgewise adjustment of said frame relative to the respective print head, and frame securing means for releasably securing said frame in fixed position relative to the respective print head, (B) work support means including a plurality of work supports for supporting work pieces to be printed, and (C) means for relatively moving said print heads and said work supports to align the work supports with the print heads in succession and effect relative movement of the work supports to successive printing positions wherein each work support is aligned with a print head and is disposed in printing relation to the screen frame of the respective print head, the improvements comprising:

registration means for registering said screen frames to said work supports by registering each screen frame directly to a selected work support when the selected work support is aligned with and occupies a certain registration position relative to the corresponding print head, and wherein said registration means comprises a registration device on said selected work support, and alignment means directly engagable with each screen frame and said registration device when said selected work support occupies said registration position at the corresponding print head for aligning the respective frame in a predetermined registered position relative to said registration device wherein the respective frame occupies a registered position relative to the corresponding print head, said frame securing means of each print head are operative to secure the corresponding screen frame in said registered position at the respective print head, said work support means comprises a rotary turret having an axis of rotation and including a work table rotatable with the turret and movable alone said axis, said work supports are mounted on and spaced circumferentially about said work table, said print heads are stationary and located at print stations spaced circumferentially about and located above said work table, said means for relatively moving said print heads and said work supports comprises means for rotating said turret and worktable stepwise to rotate said work supports to said print stations in succession and for moving said work table along said axis in timed relation to stepwise rotation of the table to elevate said work supports to said printing positions at said print stations and to lower said work supports for rotation between print stations, said alignment means comprise three registration pins mounted on one of the following: (a) the screen frame at each print head, (b) said registration device, said pins are slidably engagable in registration holes, respectively, in the other of said screen frame at each print head and said registration device after edgewise adjustment of said frame relative to said registration device to align said registration pins and holes, and said registration holes comprise elongate slots including at least two non-parallel slots.

14. The subject matter of claim 13 wherein:

said registration pins are mounted on said registration device.

15. In combination:

a screen frame, a screen frame support, a registration device to be located in a screen frame registration position adjacent said screen support, registration means directly engagable between said frame and registration device at three mutually spaced registration points arranged in a triangular pattern on said frame and said registration device when said registration device is located in said screen frame registration position for aligning said frame in a certain position relative to said registration device and said frame support, and means for releasably securing said frame in said certain position relative to said frame support.

16. The combination of claim 15 wherein:

said registration means comprise three registration pins directly engagable between said frame and said registration device at said registration points, respectively, and removably engagable in registration holes in one of said frame and registration device.

17. In combination:

a screen frame, a registration device, registration means directly engagable between said frame and registration device for aligning said frame in a fixed position relative to said registration device, and wherein said registration means comprise at least two registration pins directly engagable between said frame and said registration device and removably engagable in registration holes in one of said frame and registration device, said registration pins are three in number, and said registration holes comprise three elongate slots including at least two non-parallel slots.

18. The combination of claim 17 wherein:

said frame is rectangular in shape, and said slots are located at the corners of the frame.

19. The combination of claim 18 wherein:

each slot is disposed at approximately a 45 degree angle relative to the adjacent sides of the frame.

20. A method of registering a screen frame located at a print head of a screen printing machine relative to a work support of the machine, wherein said frame mounts a printing screen bearing a screen image to be printed, said work support receives a work piece to be imprinted in a printing position on the support, and the work support is movable to and from a registration position close to the frame, said method comprising the steps of:

providing said frame with three frame registration points precisely located in a triangular pattern relative to the screen image on the frame, providing said work support with support registration points equal in number to and arranged in the same triangular pattern as said frame registration points and located in precise predetermined positions relative to said work support, whereby said frame and work support have corresponding registration points, relatively moving said frame and work support to locate the work support in a certain registration position adjacent one side of said frame wherein the corresponding registration points of said frame and work support are aligned, engaging alignment means with said corresponding registration points to positively retain said frame and work support in said certain registration position, and securing said frame in said certain registration position relative to said print head.

21. A method of registering a screen frame located at a print head of a screen printing machine relatives to a work support of the machine, wherein said frame mounts a printing screen bearing a screen image to be printed, each work support receives a work piece to be imprinted in a printing position on the support, and the work support is movable to and from a registration position close to the frame, said method comprising the steps of:

providing said frame with at least two frame registration points precisely located relative to the screen image on the frame, providing said work support with support registration points equal in number to and arranged in the same relative positions as said frame registration points and located in a precise predetermined position relative to said work support, relatively moving said frame and work support to locate the work support in a certain registration position adjacent one side of said frame, moving the screen frame edgewise to align said frame and support registration points, securing said frame in a fixed position relative to said print head, and wherein said frame and support registration points are each three in number, the registration points on one of said frame and support comprise elongate registration slots including at least two non-parallel slots corresponding to two registration points on the other of said frame and support, and said step of moving said frame edgewise to align said frame and support registration points comprises extending two registration pins from said two registration points of said other one of said frame and support through said two non-parallel slots, rotating said frame edgewise about said two pins to align the third registration point on said other of said frame and support, and extending a third registration pin from said third registration point through the third slot to retain said frame in fixed position while said frame is being secured in said fixed position.

22. The method of registering a printing screen frame member relative to another member comprising one of the following: (A) a vacuum table for supporting an image to be printed, (B) a work support for supporting a workpiece to be imprinted with said image, said method comprising the steps of:

providing one of said members with three elongate slots including at least two non-parallel slots, providing the other member with three registration points corresponding to the three slots, respectively, and having the same relative positions as said slots at certain positions along the slots, extending two registration pins from two of said registration points of said other member through the corresponding slots of said one member, relatively moving said members about said two registration pins to align the third registration point of said other member with the third slot in said one member, and extending a third registration pin from said third registration point through said third slot to retain said members in fixed relative positions.

* * * * *